US008371394B2

(12) United States Patent
Grand

(10) Patent No.: US 8,371,394 B2
(45) **Date of Patent: *Feb. 12, 2013**

(54) IMPACT MECHANISM

(76) Inventor: Gerard Grand, St. Catharines (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/428,458

(22) Filed: Apr. 22, 2009

(65) Prior Publication Data

US 2010/0276169 A1 Nov. 4, 2010

Related U.S. Application Data

(60) Provisional application No. 61/047,101, filed on Apr. 22, 2008.

(51) Int. Cl.
*E02D 7/02* (2006.01)
*B25B 13/46* (2006.01)
*B25D 15/00* (2006.01)

(52) U.S. Cl. ..... 173/48; 173/29; 173/93.5

(58) Field of Classification Search ..... 482/48; 173/29, 93, 93.5, 109, 47–48, 128, 213; 310/50; 227/114, 54, 61

See application file for complete search history.

(56) References Cited

U.S. PATENT DOCUMENTS

| | | | | | |
|---|---|---|---|---|---|
| 2,227,627 | A * | 1/1941 | Bruzon | 173/93.6 |
| 2,712,254 | A * | 7/1955 | Schodeberg | 173/93.6 |
| 2,722,918 | A * | 11/1955 | Kimball | 173/133 |
| 3,724,560 | A * | 4/1973 | Tibbott | 173/178 |
| 4,098,354 | A * | 7/1978 | Alcenius | 173/93.5 |
| 4,243,108 | A * | 1/1981 | Galimov et al. | 173/93 |
| 4,428,439 | A * | 1/1984 | Moreno | 173/118 |
| 4,545,440 | A * | 10/1985 | Treadway | 173/132 |
| 4,824,298 | A * | 4/1989 | Lippacher et al. | 408/240 |
| 5,025,903 | A * | 6/1991 | Elligson | 192/83 |
| 5,673,758 | A * | 10/1997 | Sasaki et al. | 173/178 |
| 5,951,026 | A * | 9/1999 | Harman et al. | 279/143 |
| 5,992,538 | A * | 11/1999 | Marcengill et al. | 173/93 |
| 6,138,772 | A * | 10/2000 | Miescher et al. | 173/93.5 |
| 6,321,855 | B1 * | 11/2001 | Barnes | 173/211 |
| 6,457,535 | B1 * | 10/2002 | Tanaka | 173/48 |
| 6,668,941 | B2 * | 12/2003 | Phillips et al. | 173/93.5 |
| 6,675,910 | B1 * | 1/2004 | Lin | 173/109 |
| 6,691,796 | B1 * | 2/2004 | Wu | 173/48 |
| 6,883,617 | B2 * | 4/2005 | Putney et al. | 173/1 |
| 7,036,605 | B2 * | 5/2006 | Suzuki et al. | 173/20 |
| 7,308,948 | B2 * | 12/2007 | Furuta | 173/48 |
| 7,380,612 | B2 * | 6/2008 | Furuta | 173/29 |
| 7,380,613 | B2 * | 6/2008 | Furuta | 173/48 |
| 7,410,007 | B2 * | 8/2008 | Chung et al. | 173/48 |
| 7,410,084 | B1 * | 8/2008 | Reed | 227/119 |
| 7,494,437 | B2 * | 2/2009 | Chen | 475/149 |
| 7,588,093 | B2 * | 9/2009 | Grand et al. | 173/29 |
| 7,874,378 | B2 * | 1/2011 | Chen | 173/29 |
| 7,997,837 | B2 * | 8/2011 | Furusawa et al. | 408/239 R |
| 8,122,971 | B2 * | 2/2012 | Whitmire et al. | 173/48 |
| 8,157,021 | B2 * | 4/2012 | Chen | 173/29 |
| 2005/0077063 | A1 * | 4/2005 | Oretti | 173/29 |
| 2005/0199404 | A1 * | 9/2005 | Furuta et al. | 173/48 |
| 2006/0237205 | A1 * | 10/2006 | Sia et al. | 173/48 |

(Continued)

*Primary Examiner* — Robert Long

(57) ABSTRACT

An impact mechanism comprises a drive engaging member and a tool bit retaining member. A hammer is mounted on the drive engaging member for guided movement between an anvil contact position whereat force is transmitted from the hammer to the anvil portion so as to create a moment about the longitudinal axis, and a release position whereat the hammer is temporarily removed from the anvil portion. A spring biases the hammer to the anvil contact position. A main body member has an internal thread and is threadably engaged on a co-operating external thread on the drive engaging member. The spring is operatively interconnected between the main body member and the hammer member, to thereby permit selective compression of the spring through rotation of the manually manipulable handle.

24 Claims, 29 Drawing Sheets

U.S. PATENT DOCUMENTS

2007/0068692 A1* 3/2007 Puzio ..... 173/217
2008/0289841 A1* 11/2008 Kang ..... 173/48
2009/0056966 A1* 3/2009 Grand et al. ..... 173/93.5
2010/0000749 A1* 1/2010 Andel ..... 173/48

* cited by examiner 230
247
240
247

230
245
245
247
247
240
220

IMPACT MECHANISM

This application is a non-provisional application claiming priority to U.S. provisional patent application Ser. No. 61/047,101 filed on Apr. 22, 2008, which is herein incorporated by reference.

FIELD OF THE INVENTION

The present invention relates to impact mechanisms, and more particularly to impact mechanisms that are selectively mountable on an electric drill or the like.

BACKGROUND OF THE INVENTION

It is known to use a series of impacts of a hammer member on an anvil member to provide a significant force and highly effective rotational force in an impact driver. However, it is not known in the prior art to provide a portable assembly that is operatively engageable with the chuck of an electric drill or the like, which assembly provides a high impact rotational force, for turning a threaded fastener into a receiving article, such as a piece of wood, or removing a threaded fastener from a co-operating threaded shaft, and so on. It is also not known in the prior art to be able to readily adjust the impact rotational force of the impact driver.

It is an object of the present invention to provide a portable impact driver that is operatively engageable with the chuck of an electric drill or the like, which impact driver provides a high impact rotational force.

It is another object of the present invention to provide a portable impact driver that is operatively engageable with the chuck of an electric drill or the like, wherein it is possible to readily adjust the impact rotational force of the impact driver.

SUMMARY OF THE INVENTION

In accordance with one aspect of the present invention there is disclosed a novel impact mechanism for use with a drive motor. The impact mechanism comprises a drive engaging member for engaging a rotatable output of a drive motor for rotation therewith about a longitudinal axis. A tool bit retaining member is operatively inter-connected with the drive engaging member for rotation with respect to the drive engaging member about the longitudinal axis. The tool bit retaining member has a main body portion, an anvil portion securely attached thereto for co-rotation with the main body portion, and a tool bit retaining means securely attached thereto for co-rotation with the main body portion. A hammer member is mounted on one of the drive engaging member and the tool bit retaining member for movement between an anvil contact position whereat force is transmitted from the hammer member to the anvil portion so as to create a moment about the longitudinal axis, and a release position whereat the hammer member is temporarily removed from the anvil portion. There is a guide means for moving the hammer member between the anvil contact position and the release position when the drive engaging member is rotated with respect to the tool bit retaining member. A spring means is operatively interconnected between the drive engaging member and the hammer member for biasing the hammer member to the anvil contact position. A selectively adjustable spring compression mechanism is provided for permitting selective compression of the spring means. In use, rotation of the drive engaging member about the longitudinal axis causes the hammer member to move from its anvil contact position towards its release position, thereby storing potential energy in the spring means.

When the hammer member reaches the release position, the hammer member is forcefully propelled by the spring means and the rotation of the drive engaging member to impact on the anvil portion, thus urging the tool bit retaining member to forcefully rotate about the longitudinal axis.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the impact mechanism according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED AND ALTERNATIVE EMBODIMENTS

Figure 1:
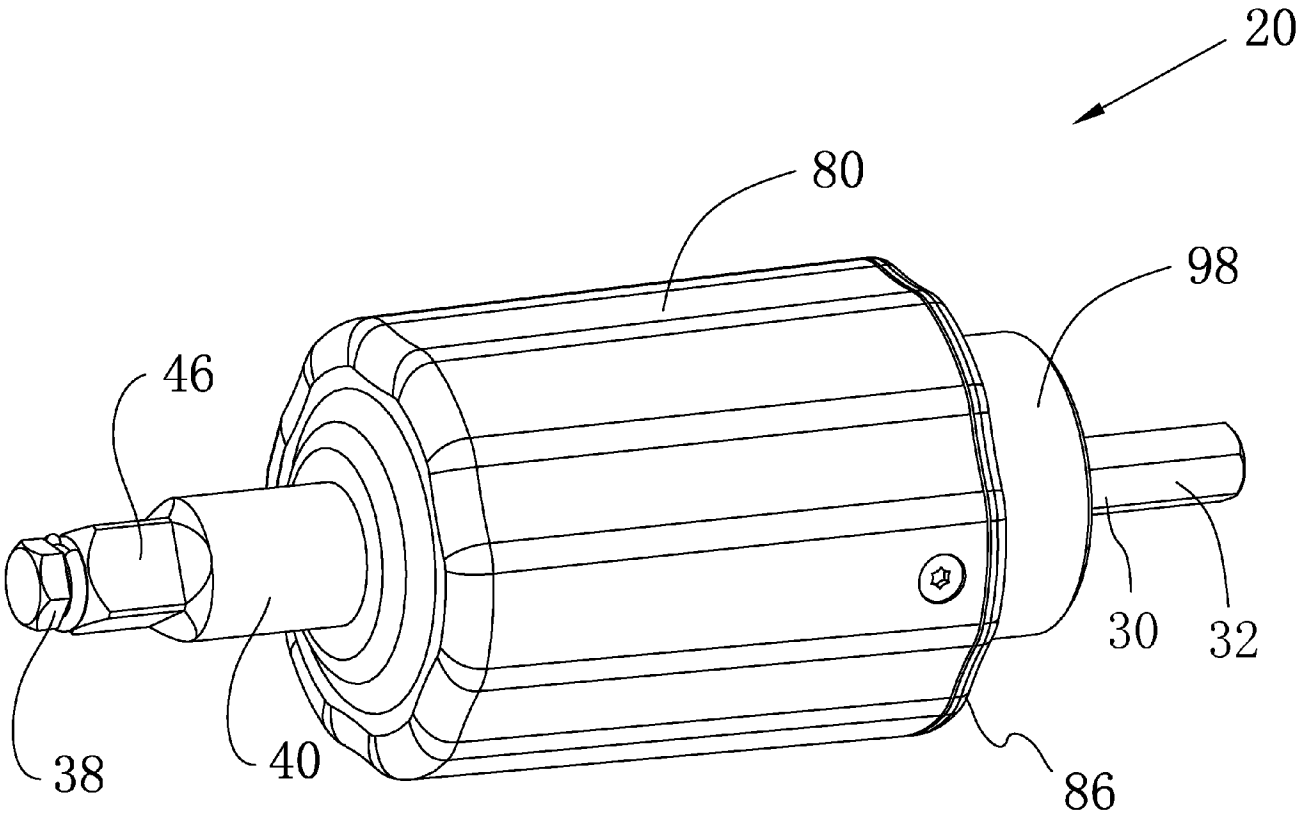
FIG. 1 is a perspective view from the front of the first preferred embodiment of the impact mechanism according to the present invention.
Figure 2:
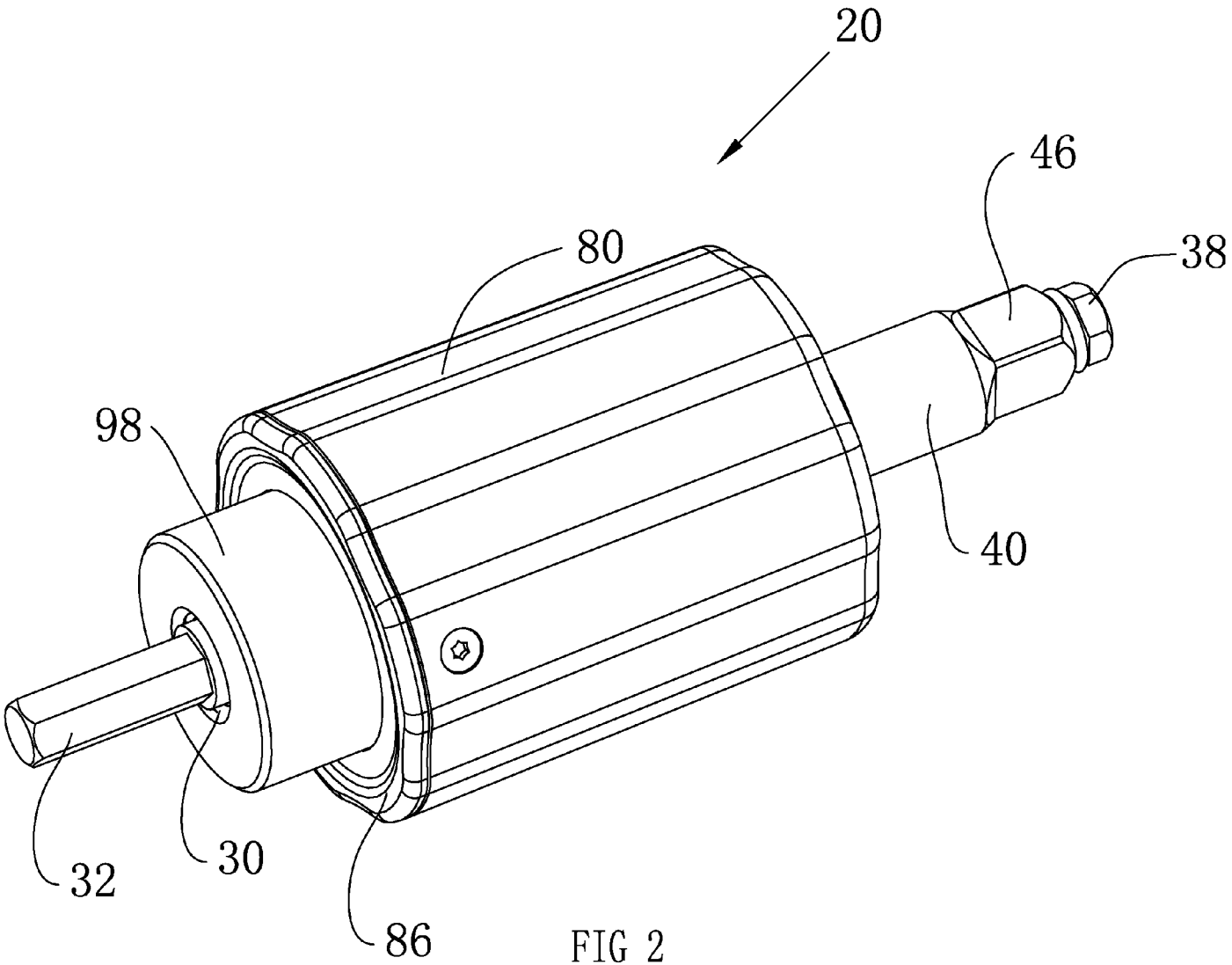
FIG. 2 is a perspective view from the rear of the first preferred embodiment of the impact mechanism of FIG. 1.
Figure 3:
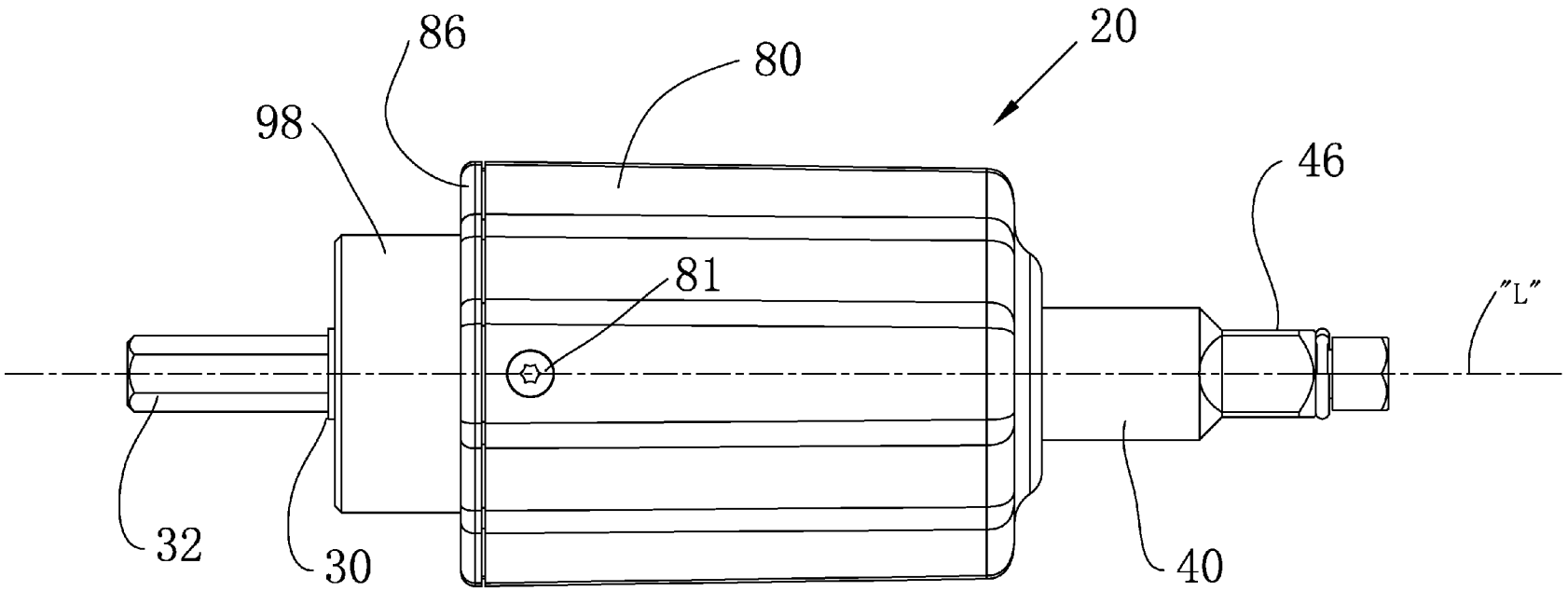
FIG. 3 is a side elevational view of the first preferred embodiment of the impact mechanism of FIG. 1.
Figure 4:
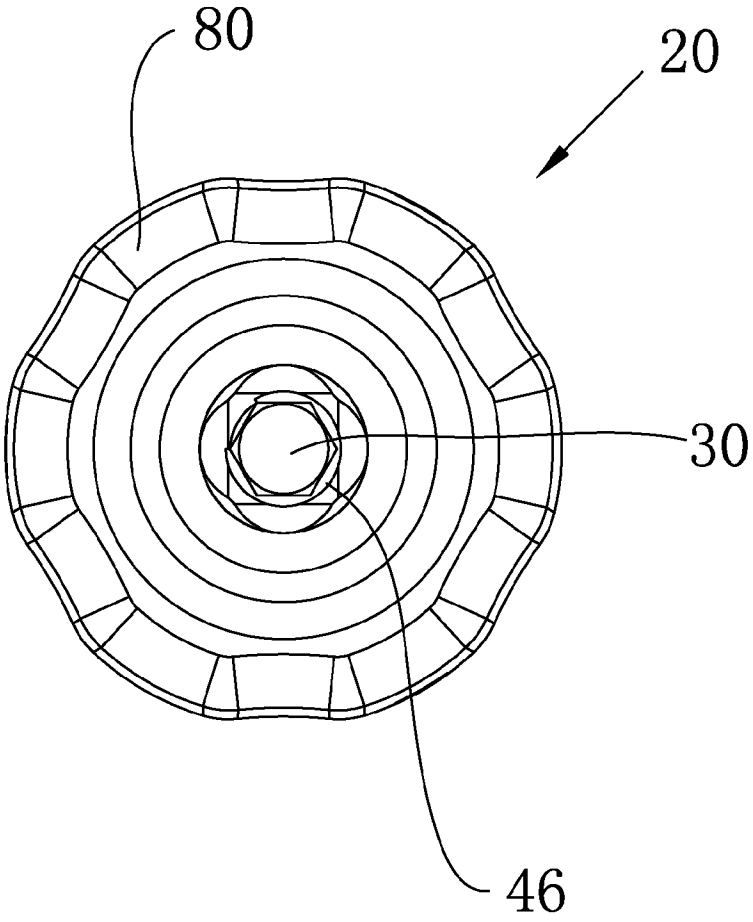
FIG. 4 is a front end elevational view of the first preferred embodiment of the impact mechanism of FIG. 1.
Figure 5:
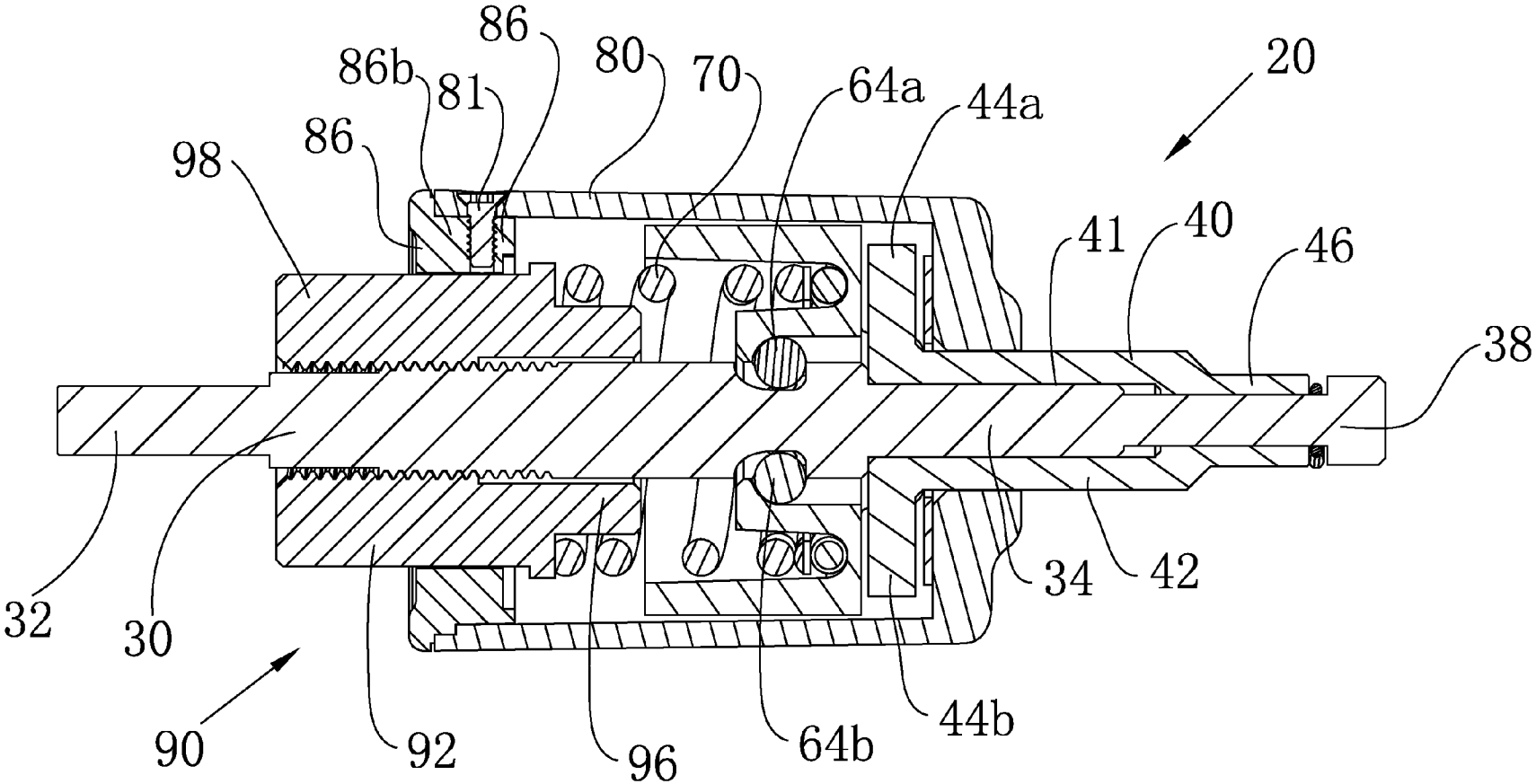
FIG. 5 is a cross-sectional side elevational view of the first preferred embodiment of the impact mechanism of FIG. 1, taken along section line 5-5 of FIG. 4.
Figure 6:
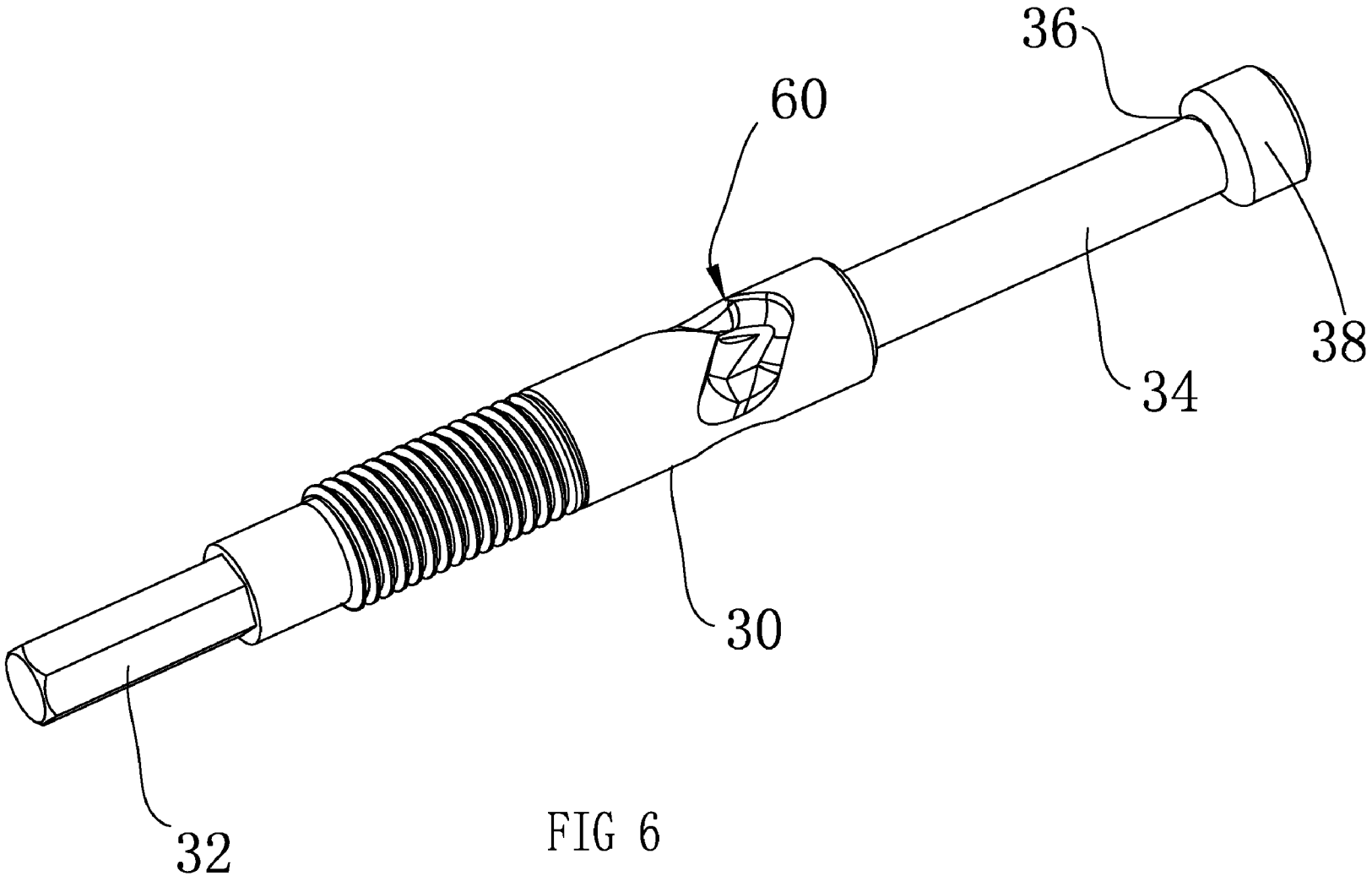
FIG. 6 is a perspective view of the drive engaging member of the first preferred embodiment of the impact mechanism of FIG. 1.
Figure 7:
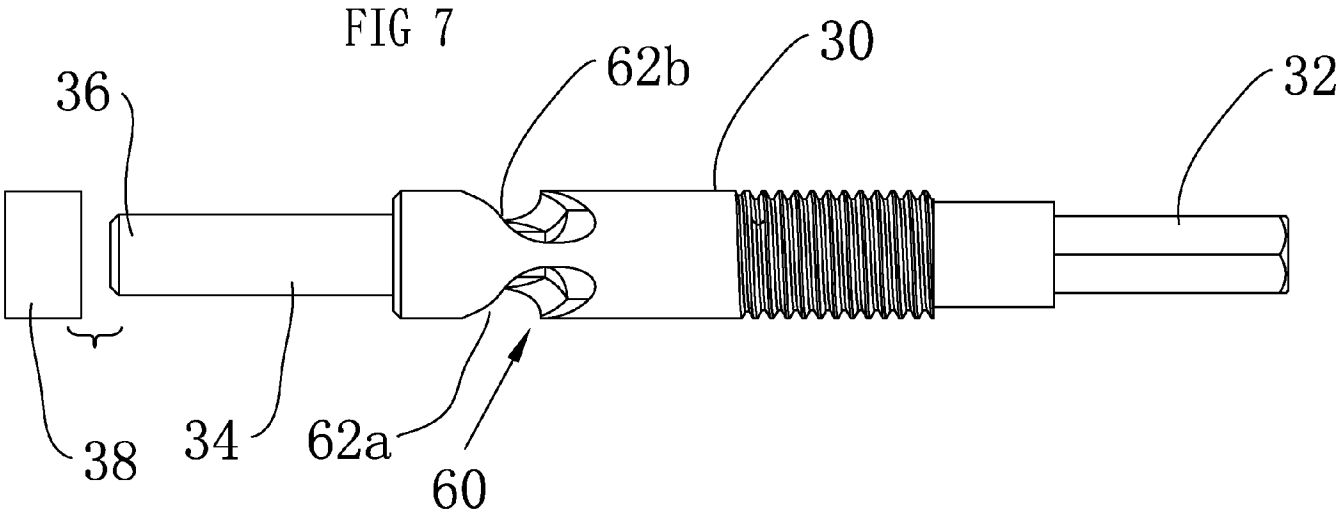
FIG. 7 is a side elevational view of the drive engaging member of the first preferred embodiment of the impact mechanism of FIG. 1.
Figure 8:
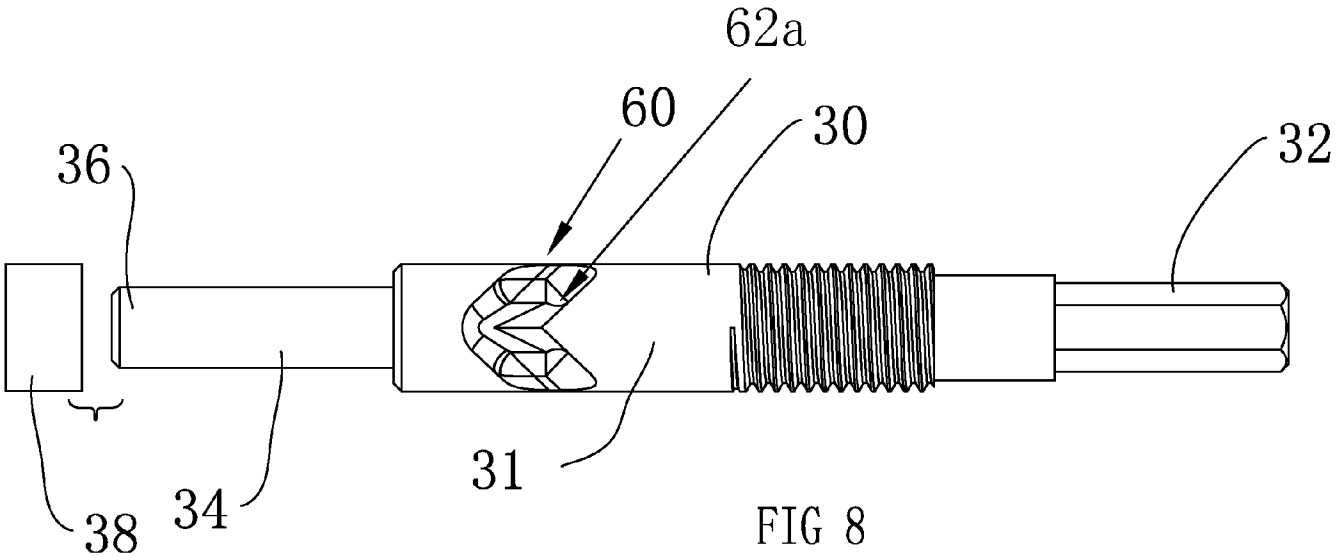
FIG. 8 is a top plan view of the drive engaging member of the first preferred embodiment of the impact mechanism of FIG. 1.
Figure 10:
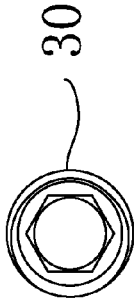
FIG. 10 is a back end view of the drive engaging member of the first preferred embodiment of the impact mechanism of FIG. 1.
Figure 9:
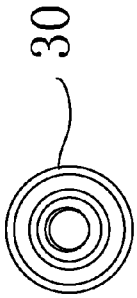
FIG. 9 is a front end view of the drive engaging member of the first preferred embodiment of the impact mechanism of FIG. 1.
Figure 11:
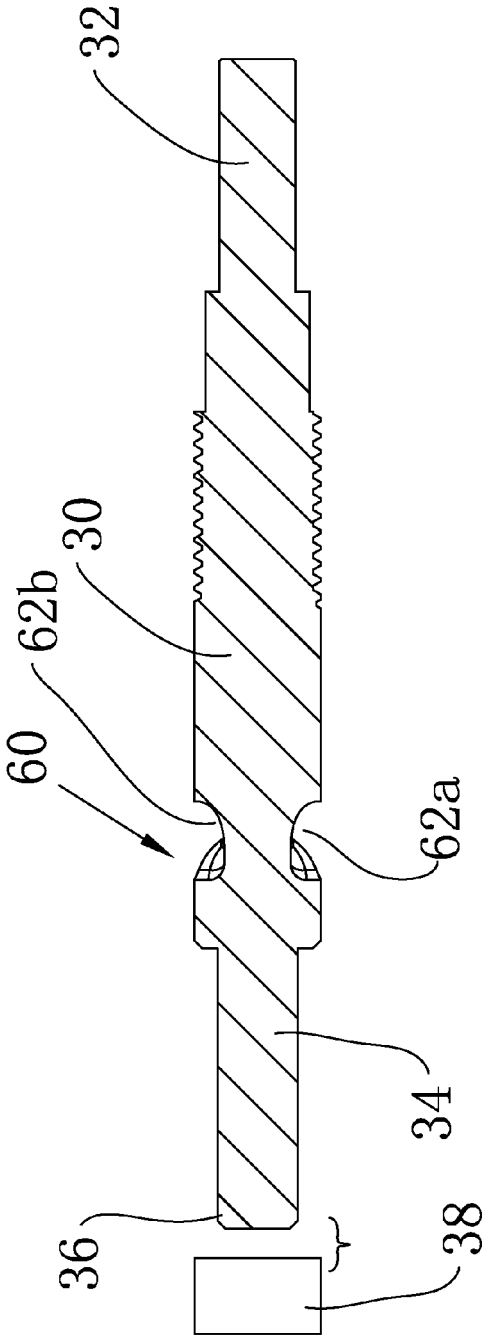
FIG. 11 is a cross-sectional side elevational view of the drive engaging member of the first preferred embodiment of the impact mechanism of FIG. 1, taken along section line 11-11 of FIG. 8.
Figure 13:
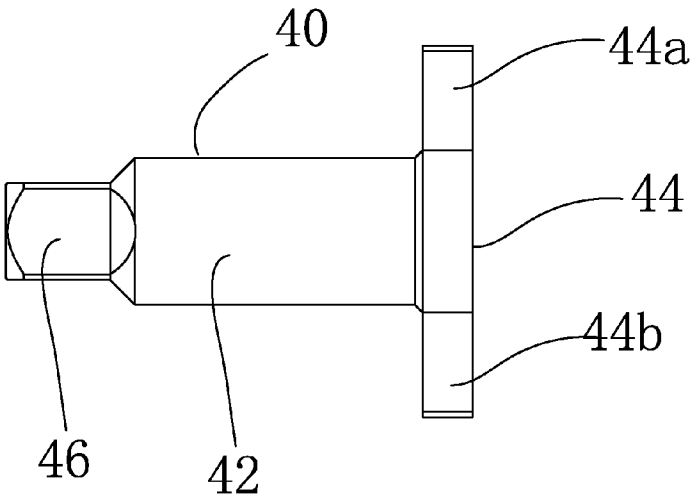
FIG. 13 is a left side elevational view of the tool bit retaining member of the first preferred embodiment of the impact mechanism of FIG. 1.
Figure 12:
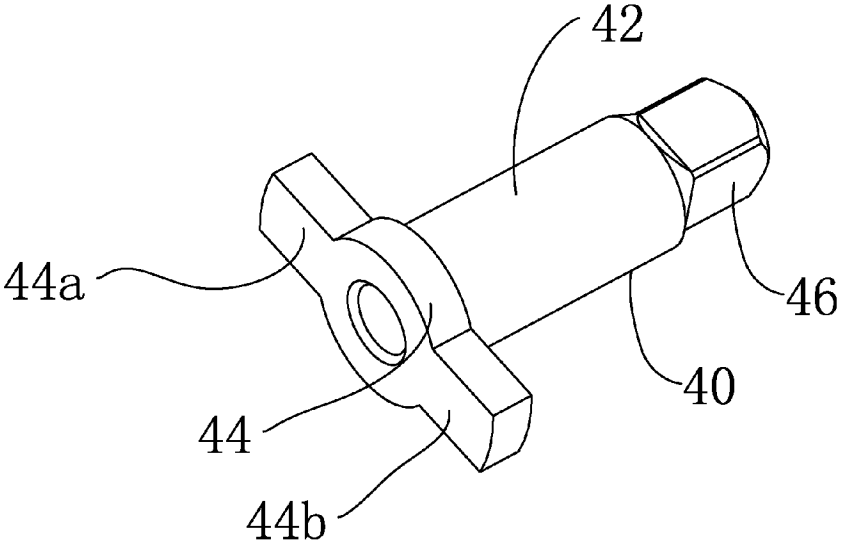
FIG. 12 is a perspective view of the tool bit retaining member of the first preferred embodiment of the impact mechanism of FIG. 1.
Figure 15:
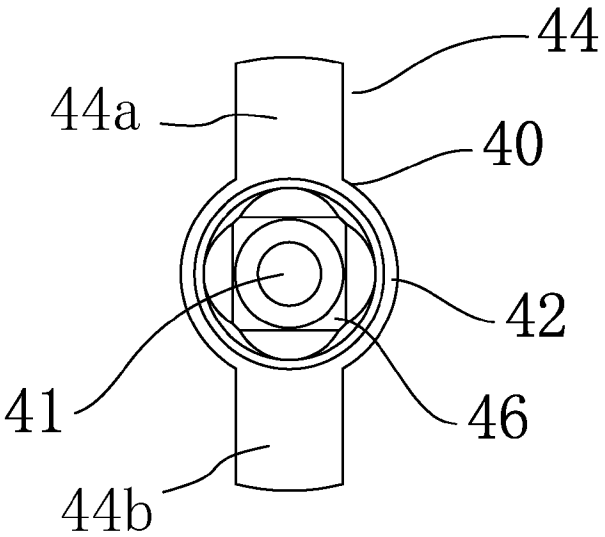
FIG. 15 is a front end view of the tool bit retaining member of the first preferred embodiment of the impact mechanism of FIG. 1.
Figure 14:
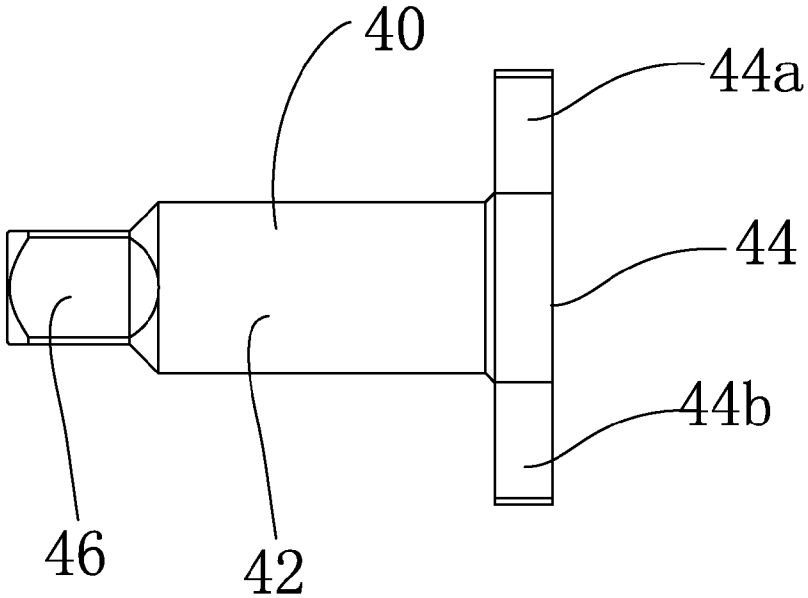
FIG. 14 is a right side elevational view of the tool bit retaining member of the first preferred embodiment of the impact mechanism of FIG. 1.
Figure 17:
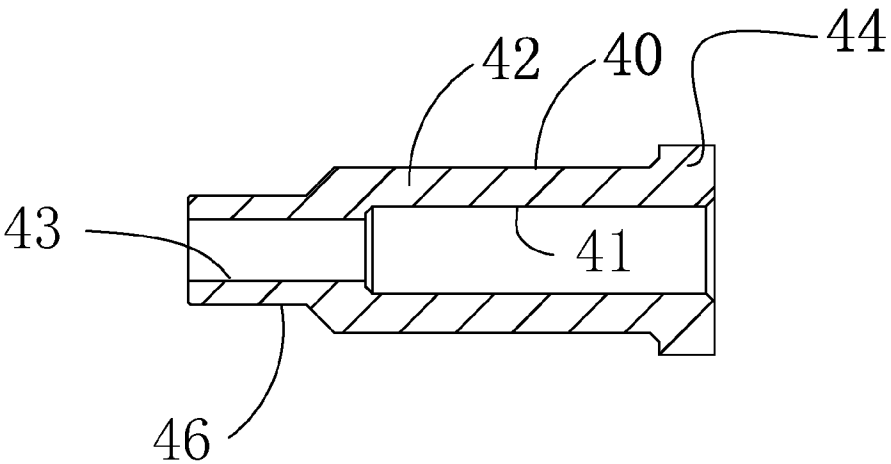
FIG. 17 is a cross-sectional side elevational view of the tool bit retaining member of the first preferred embodiment of the impact mechanism of FIG. 1, taken along section line 17-17 of FIG. 13.
Figure 16:
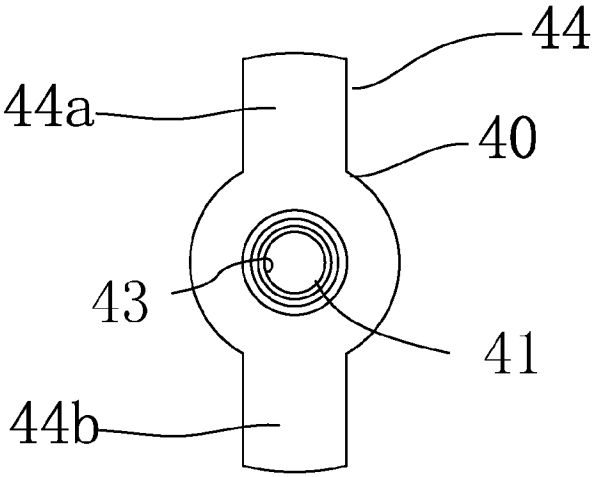
FIG. 16 is a back end view of the tool bit retaining member of the first preferred embodiment of the impact mechanism of FIG. 1.
Figure 19:
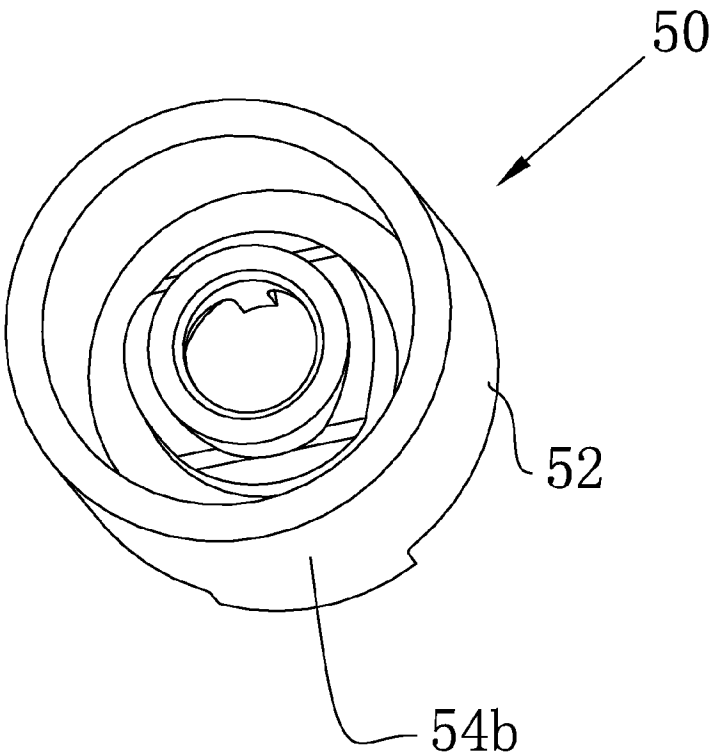
FIG. 19 is a perspective view from the back of the hammer member of the first preferred embodiment of the impact mechanism of FIG. 1.
Figure 18:
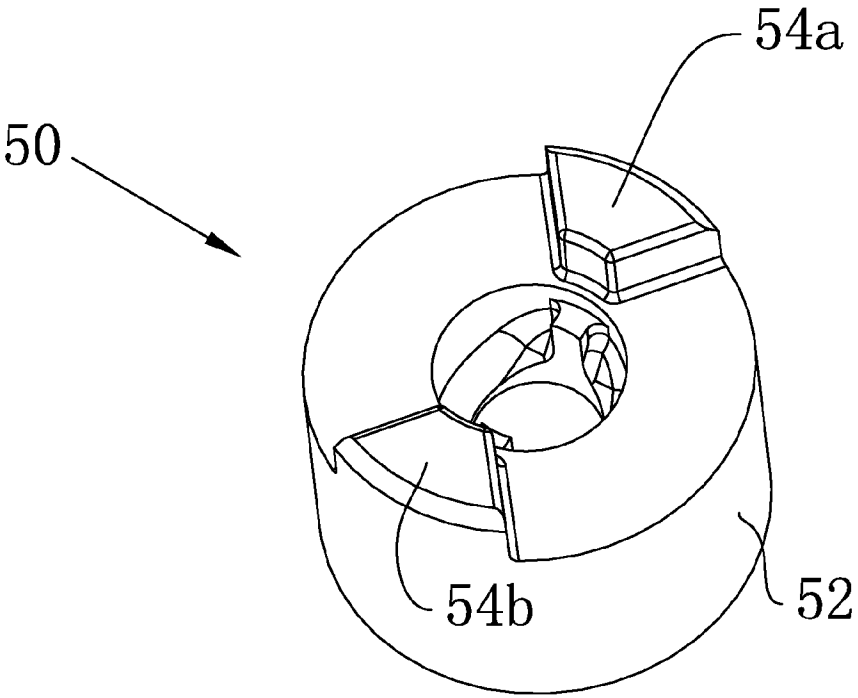
FIG. 18 is a perspective view from the front of the hammer member of the first preferred embodiment of the impact mechanism of FIG. 1.
Figures 20, 21:
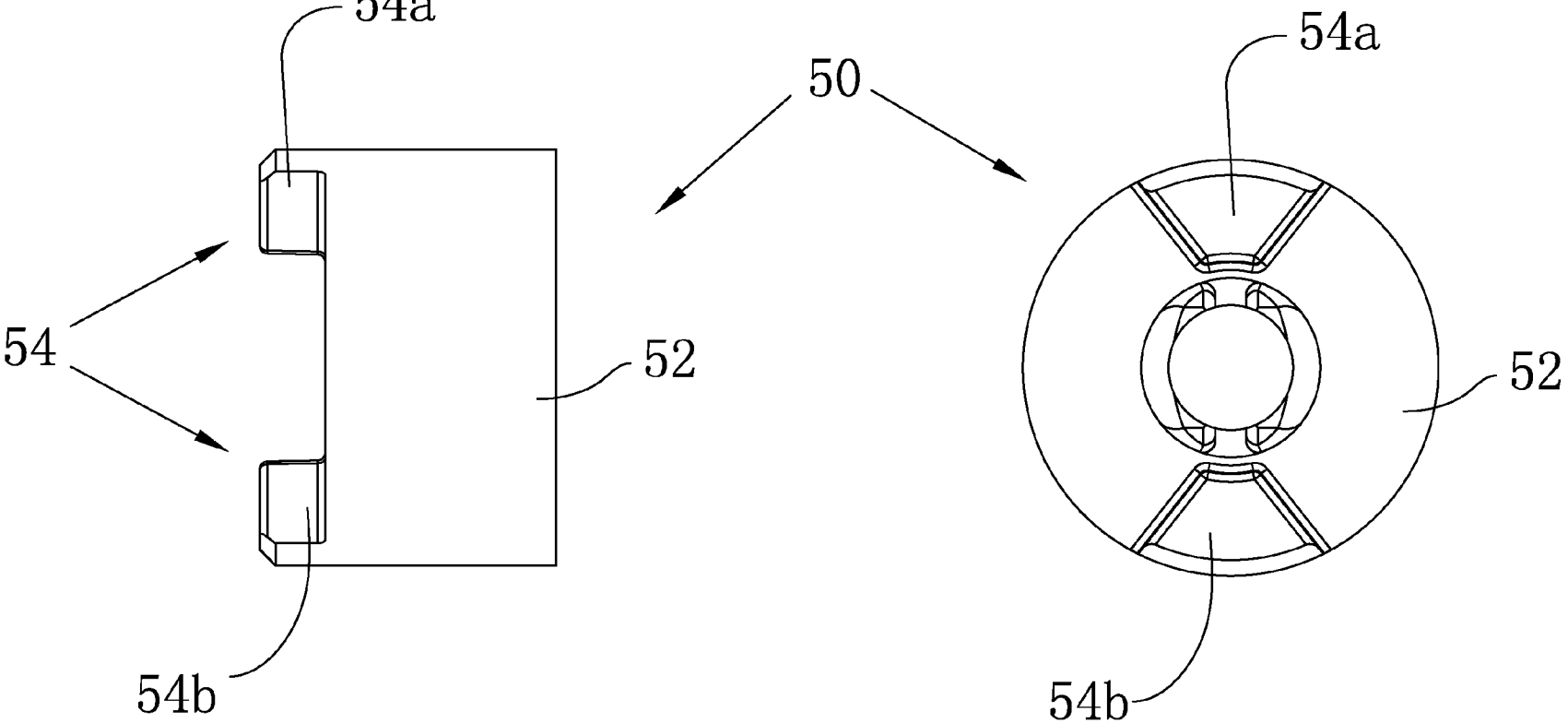
FIG. 20 is a side elevational view of the hammer member of the first preferred embodiment of the impact mechanism of FIG. 1.
FIG. 21 is a front end view of the hammer member of the first preferred embodiment of the impact mechanism of FIG. 1.
Figure 23:
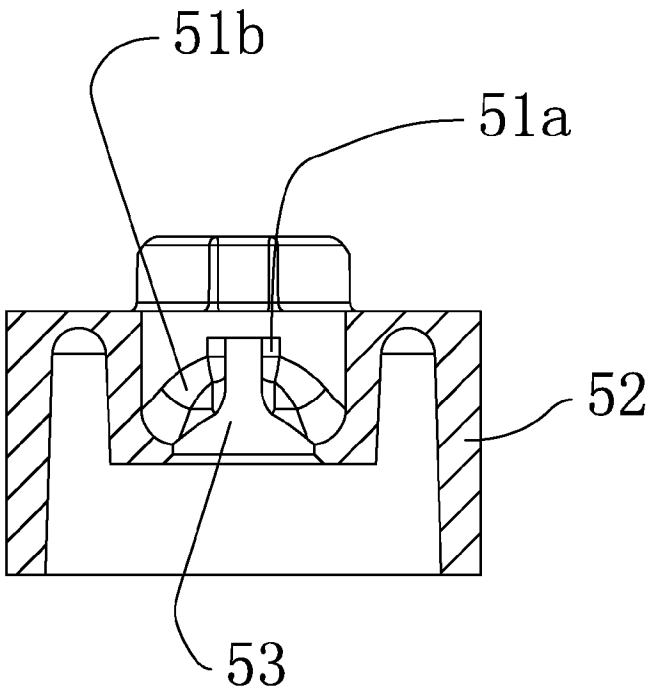
FIG. 23 is a cross-sectional side elevational view of the hammer member of the first preferred embodiment of the impact mechanism of FIG. 1, taken along section line 23-23 of FIG. 21.
Figure 22:
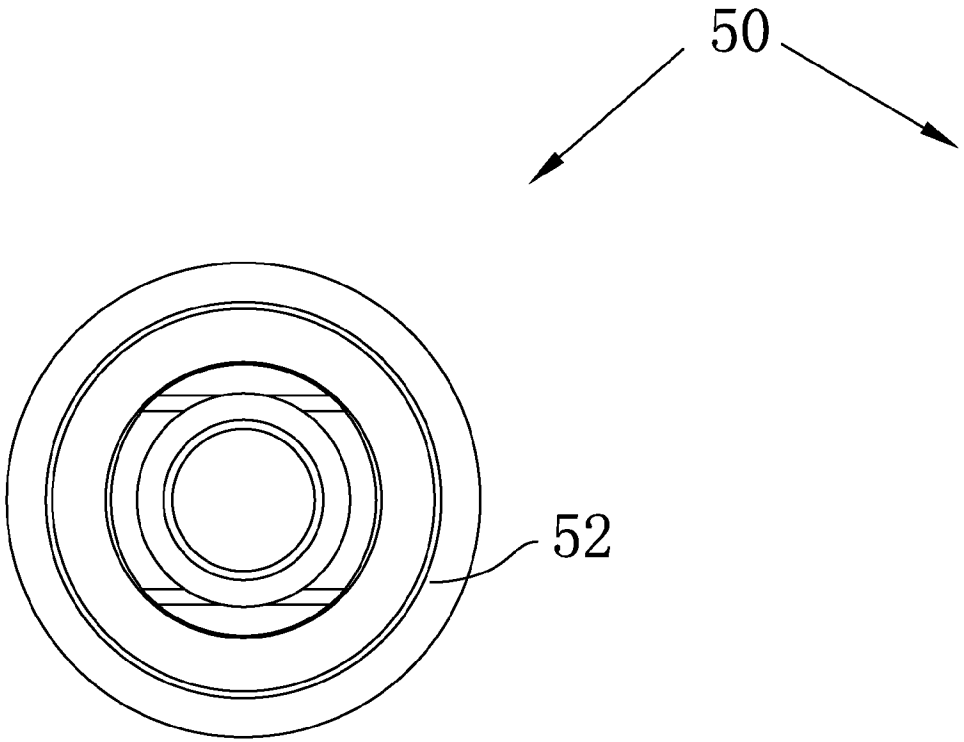
FIG. 22 is a back end view of the hammer member of the first preferred embodiment of the impact mechanism of FIG. 1.
Figure 25:
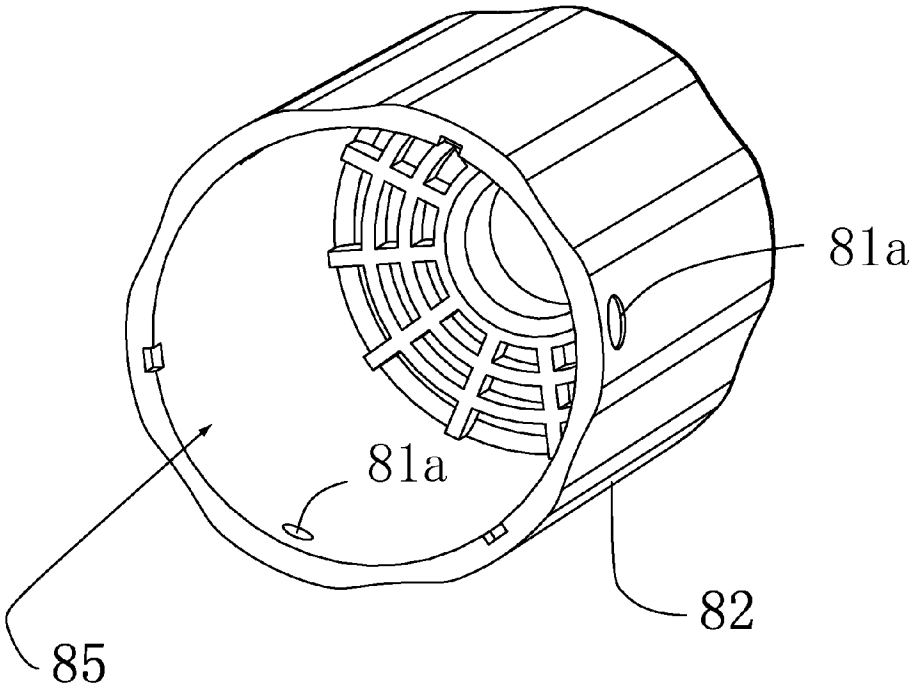
FIG. 25 is a perspective view from the back of the housing of the first preferred embodiment of the impact mechanism of FIG. 1.
Figure 24:
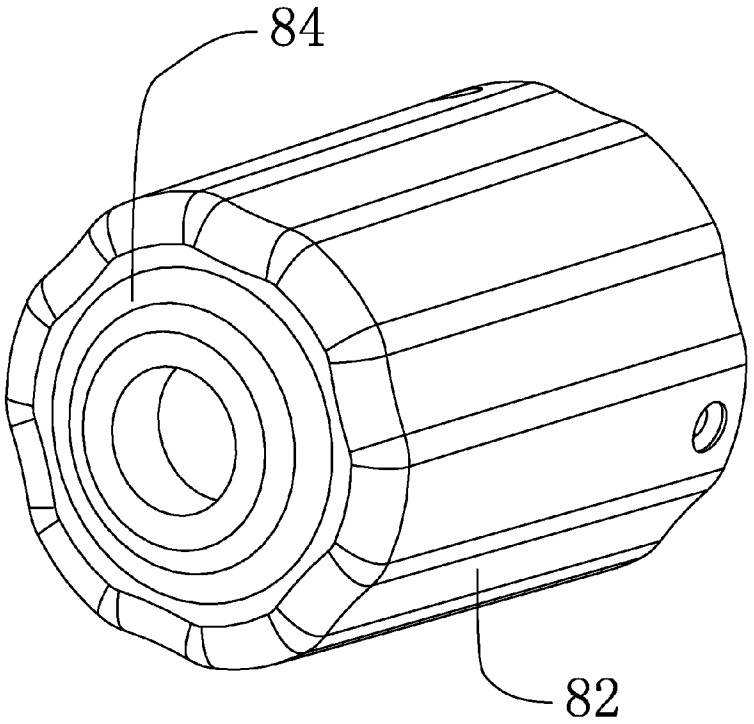
FIG. 24 is a perspective view from the front of the housing of the first preferred embodiment of the impact mechanism of FIG. 1.
Figure 26:
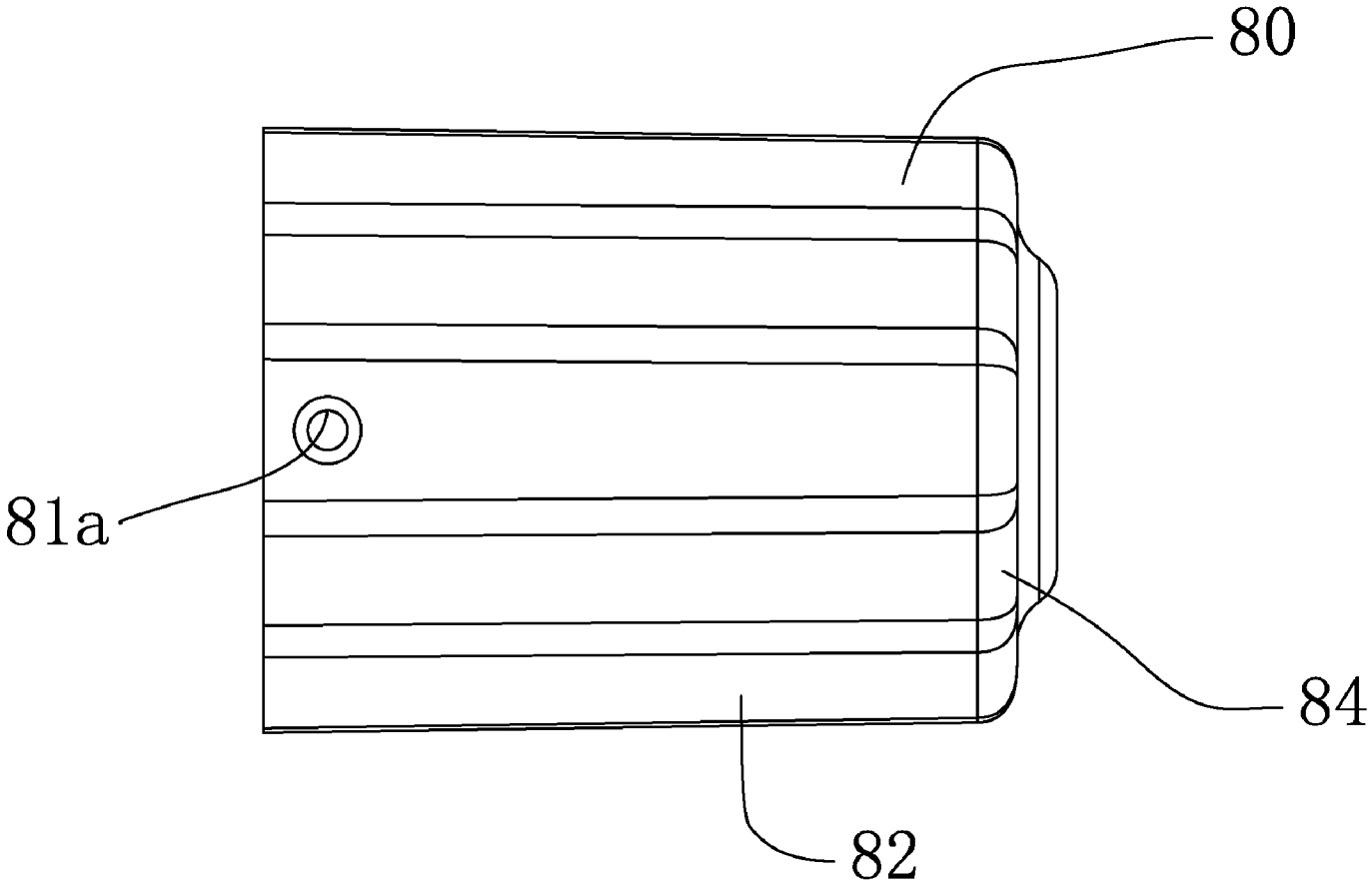
FIG. 26 is a side elevational view of the housing of the first preferred embodiment of the impact mechanism of FIG. 1.
Figure 28:
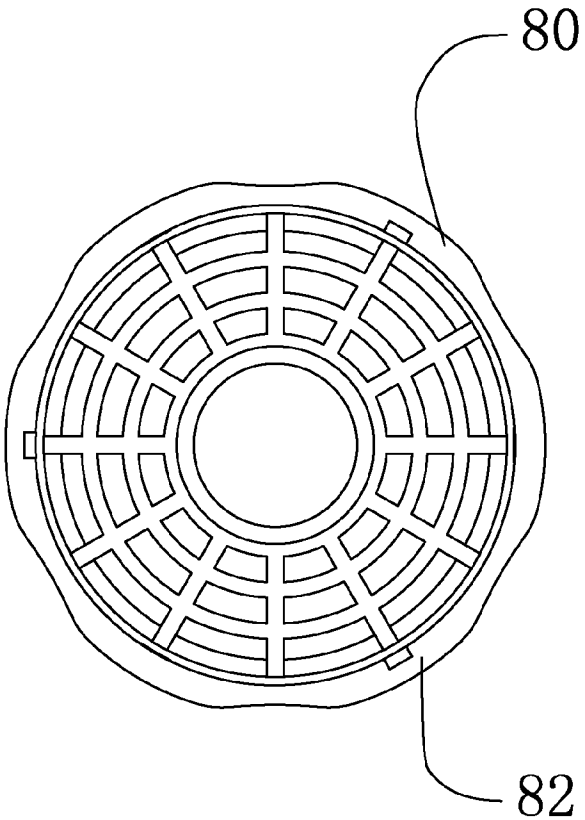
FIG. 28 is a back end view of the housing of the first preferred embodiment of the impact mechanism of FIG. 1.
Figure 27:
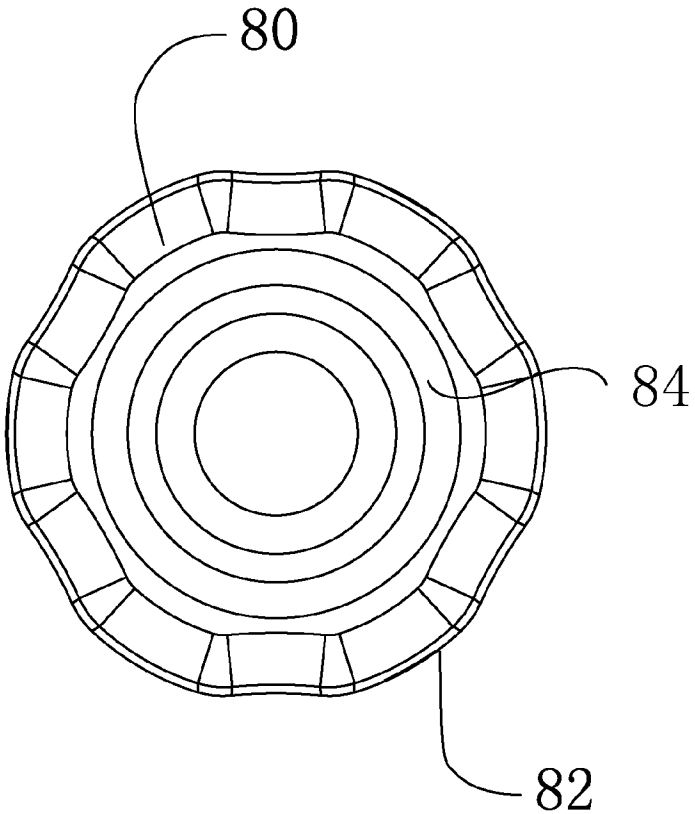
FIG. 27 is a front end view of the housing of the first preferred embodiment of the impact mechanism of FIG. 1.
Figure 30:
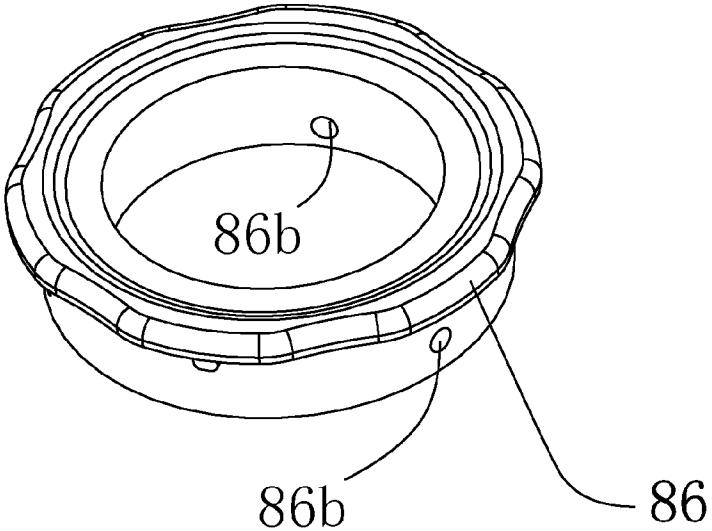
FIG. 30 is a perspective view from the front of the back end wall of the housing of the first preferred embodiment of the impact mechanism of FIG. 1.
Figure 29:
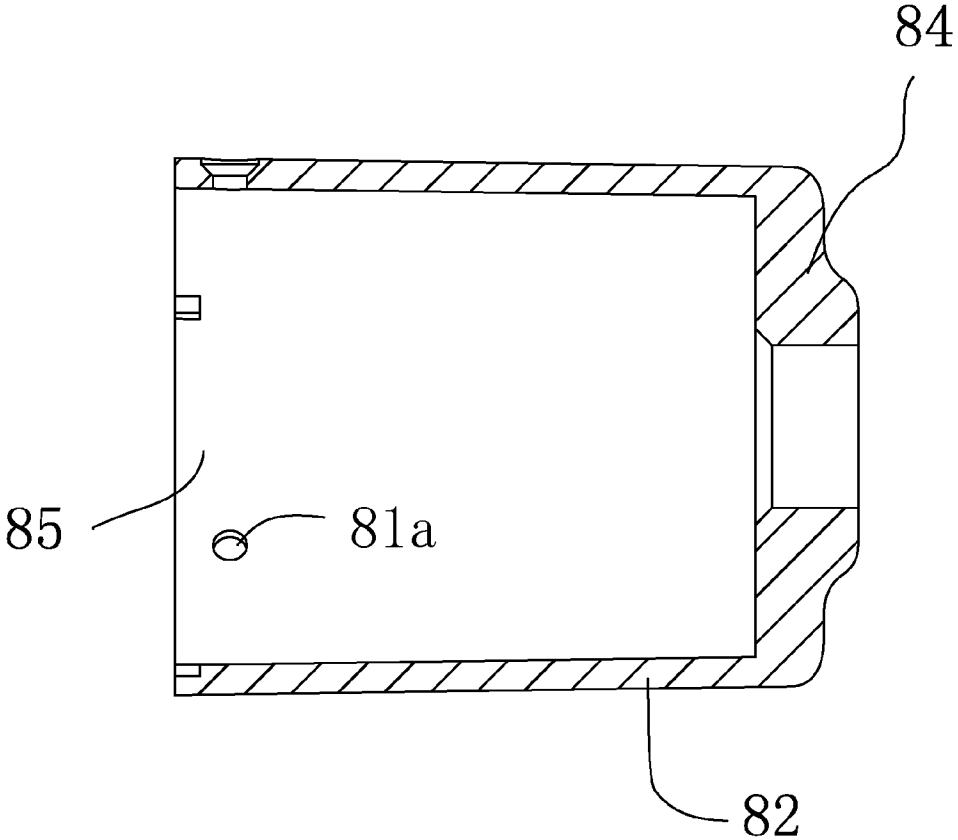
FIG. 29 is a cross-sectional side elevational view of the housing of the first preferred embodiment of the impact mechanism of FIG. 1, taken along section line 29-29 of FIG. 26.
Figure 32:
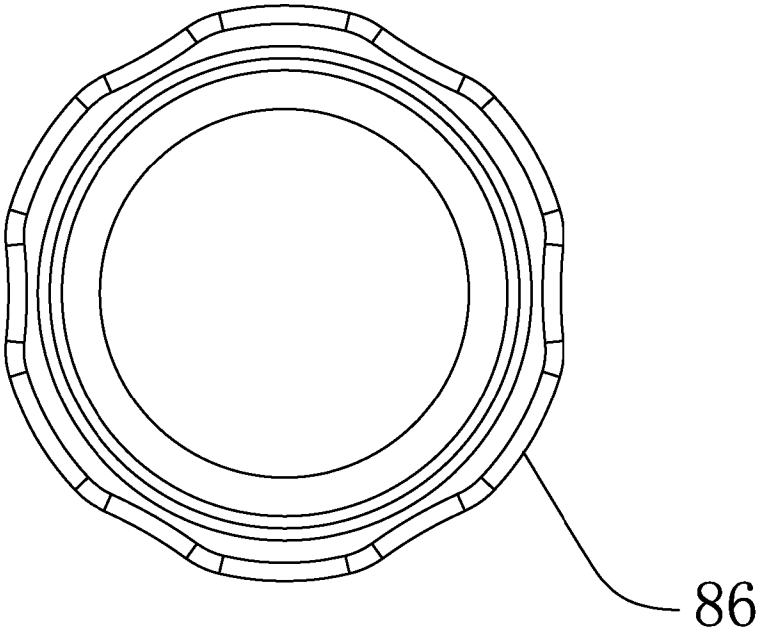
FIG. 32 is a front end view of the back end wall of the housing of the first preferred embodiment of the impact mechanism of FIG. 1.
Figure 31:
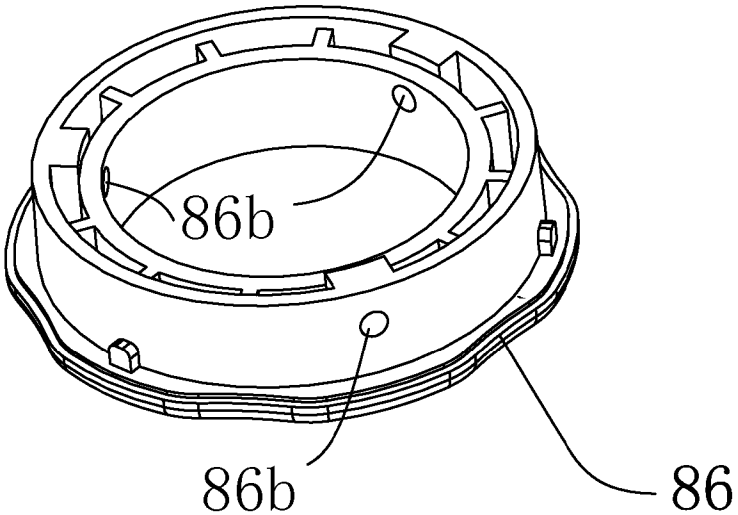
FIG. 31 is a perspective view from the back of the back end wall of the housing of the first preferred embodiment of the impact mechanism of FIG. 1.
Figure 35:
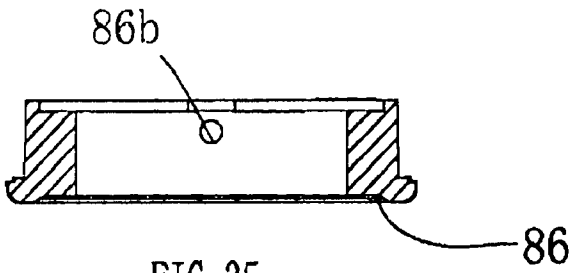
FIG. 35 is a cross-sectional side elevational view of the back end wall of the housing of the first preferred embodiment of the impact mechanism of FIG. 1, taken along section line 35-35 of FIG. 33.
Figure 34:
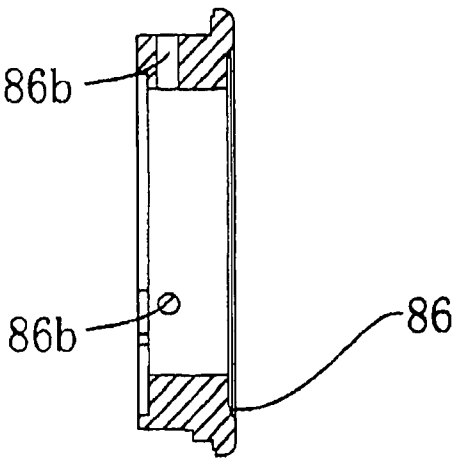
FIG. 34 is a cross-sectional side elevational view of the back end wall of the housing of the first preferred embodiment of the impact mechanism of FIG. 1, taken along section line 34-34 of FIG. 33.
Figure 33:
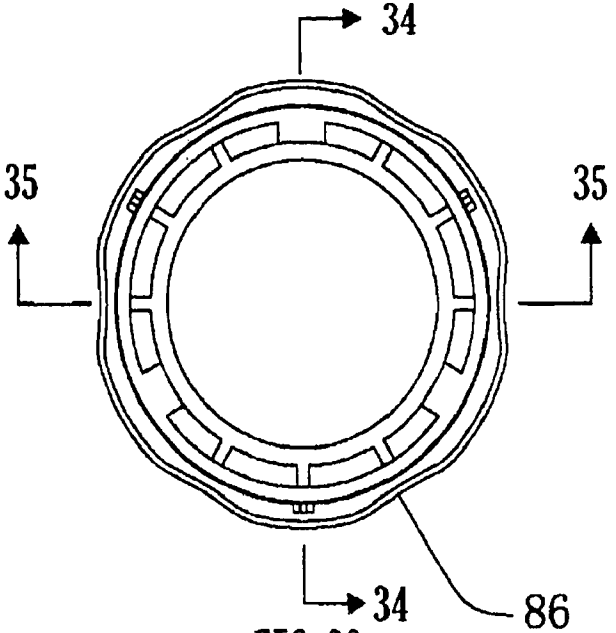
FIG. 33 is a back end view of the back end wall of the housing of the first preferred embodiment of the impact mechanism of FIG. 1.
Figure 37:
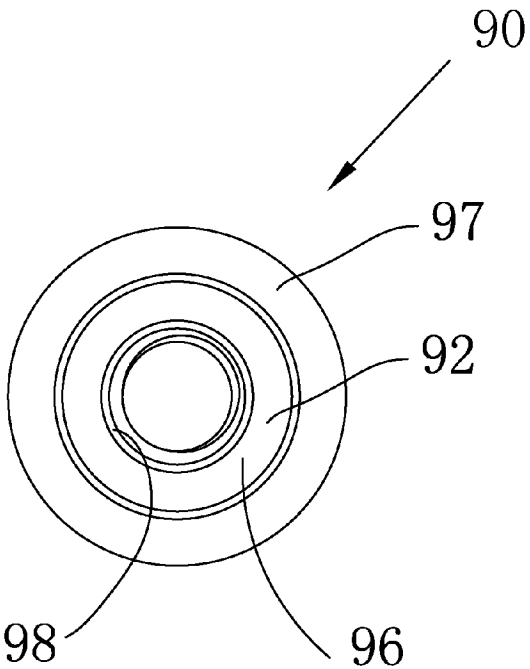
FIG. 37 is a front end view of the annular main body member of the first preferred embodiment of the impact mechanism of FIG. 1.
Figure 36:
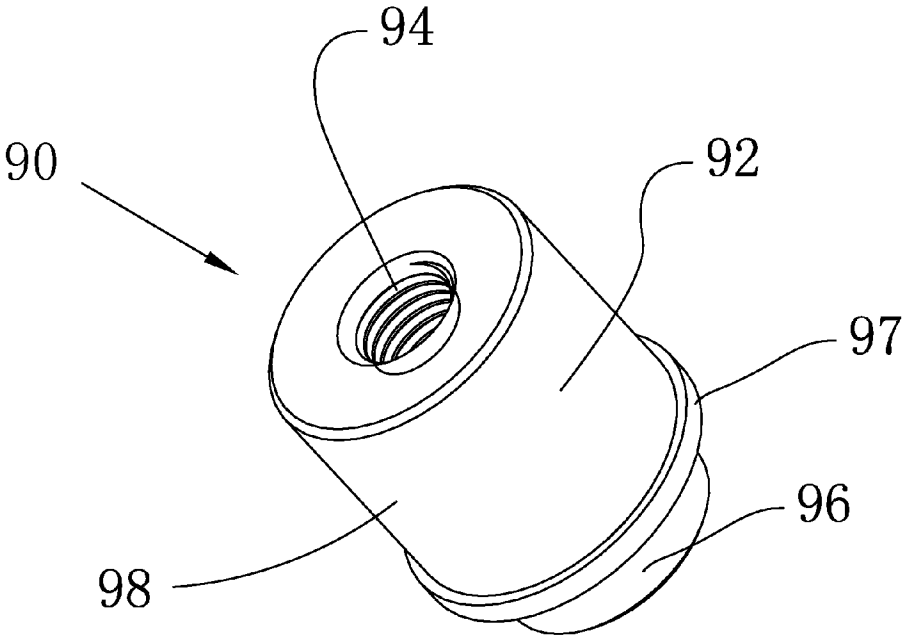
FIG. 36 is a perspective view from the front of the annular main body member of the first preferred embodiment of the impact mechanism of FIG. 1.
Figure 39:
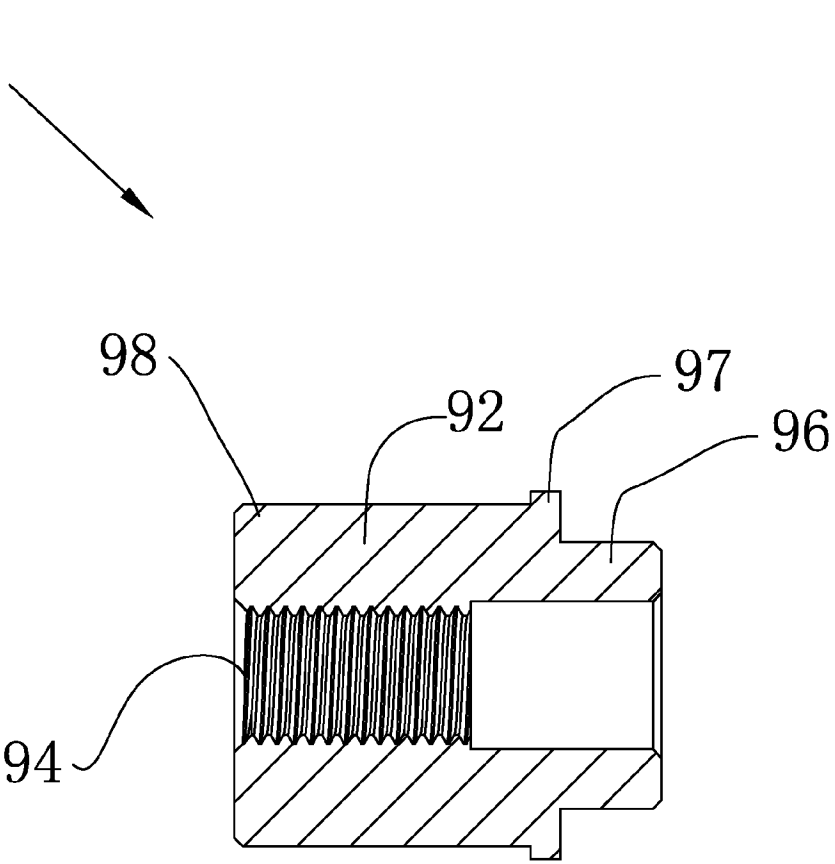
Figure 38:
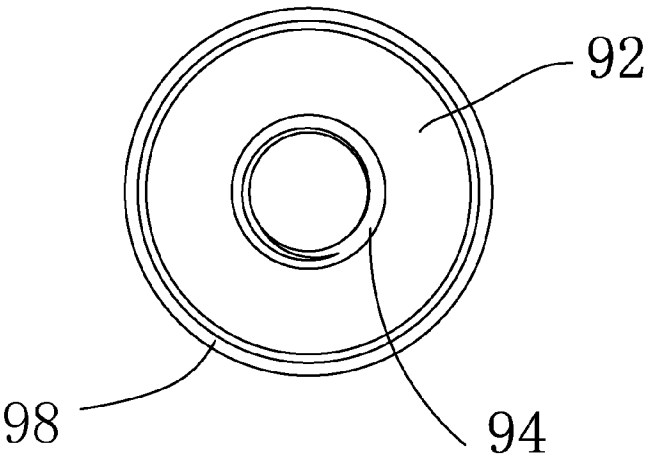
FIG. 38 is a back end view of the annular main body member of the first preferred embodiment of the impact mechanism of FIG. 1; and, FIG. 39 is a cross-sectional side elevational view of the annular main body member of the first preferred embodiment of the impact mechanism of FIG. 1, taken along section line 39-39 of FIG. 38.
Figures 40, 41:
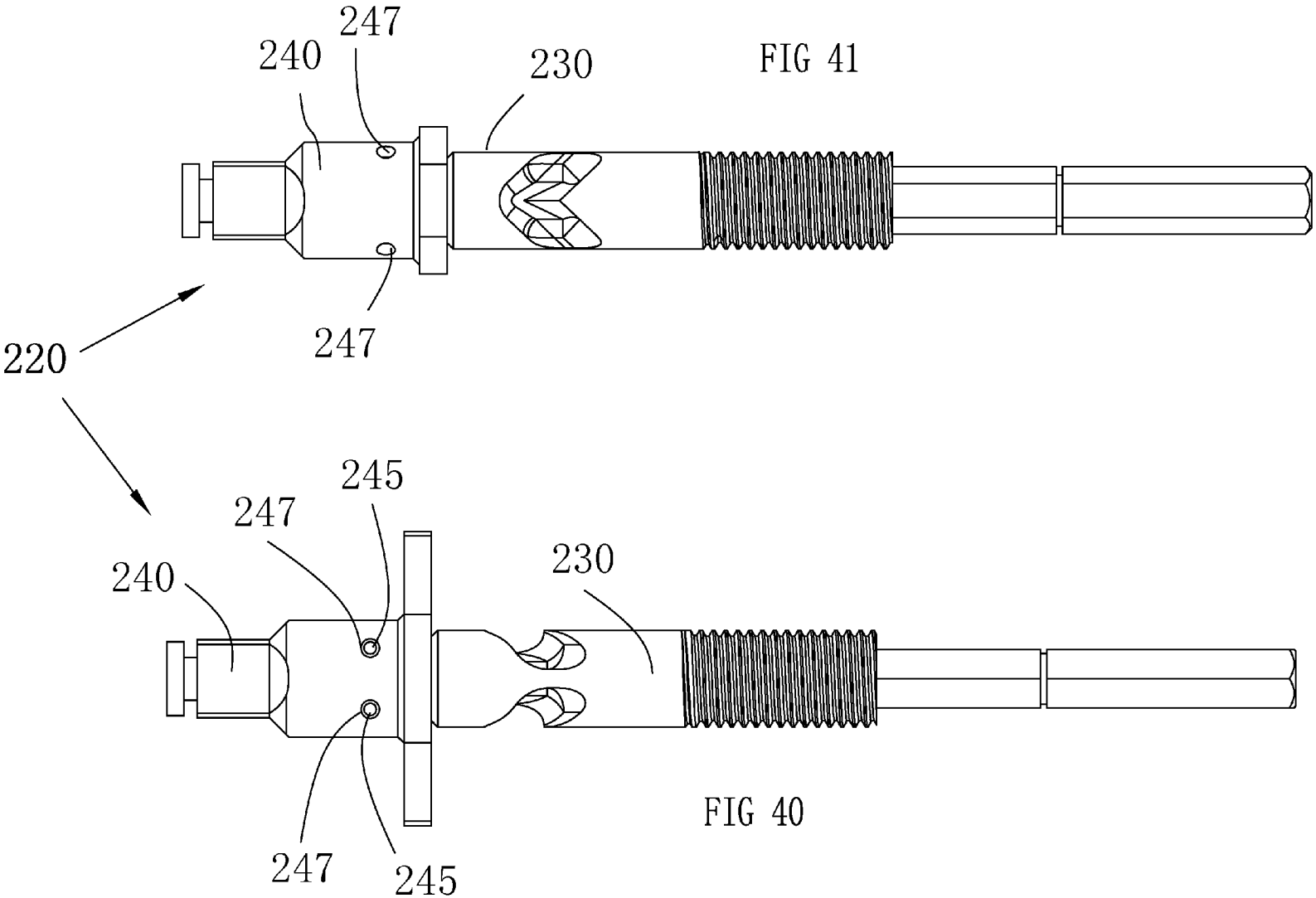
FIG. 40 is a side elevational view of the second preferred embodiment of the impact mechanism according to the present invention.
FIG. 41 is another side elevational view of the second preferred embodiment of the impact mechanism of FIG. 40.
Figure 43:
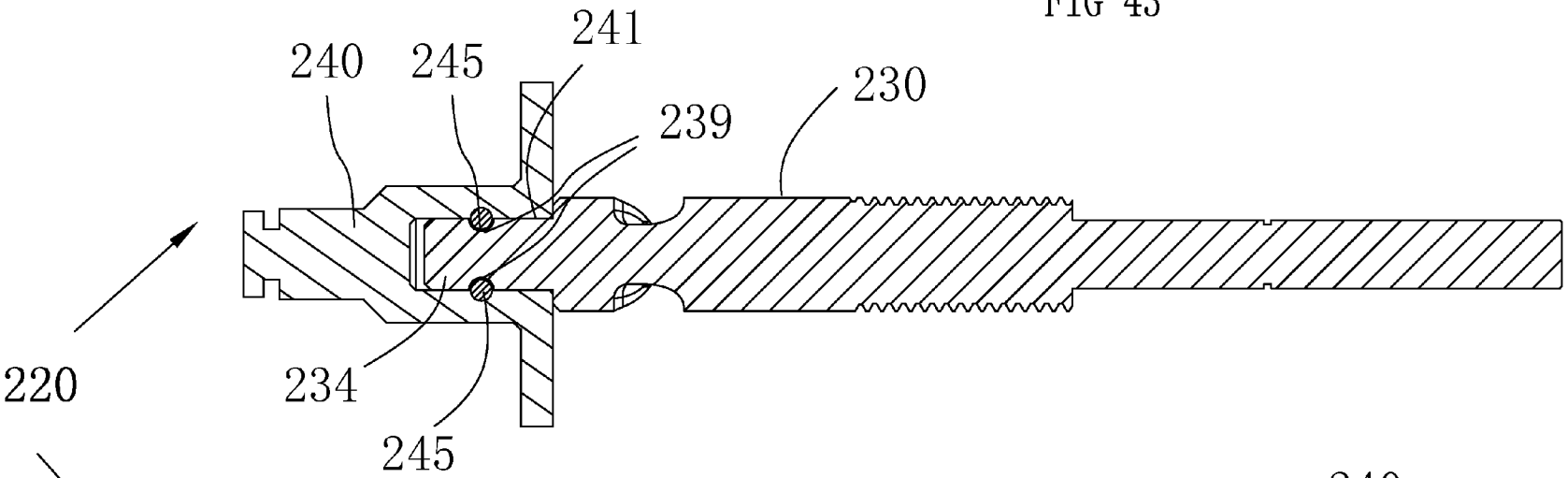
FIG. 43 is a cross-sectional side elevational view of the second preferred embodiment of the impact mechanism of FIG. 40, taken along section line 43-43 of FIG. 41.
Figure 44:
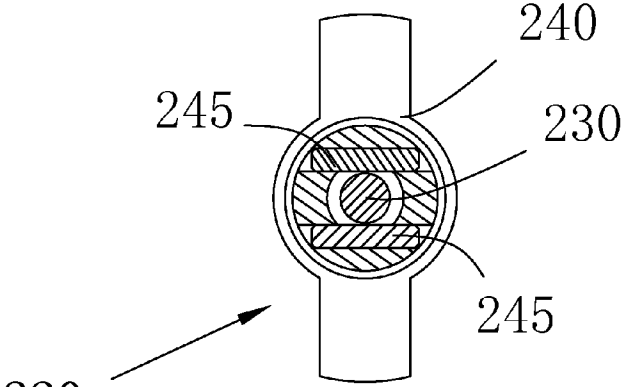
FIG. 44 is a cross-sectional end elevational view of the second preferred embodiment of the impact mechanism of FIG. 41, taken along section line 44-44 of FIG. 41.
Figure 42:
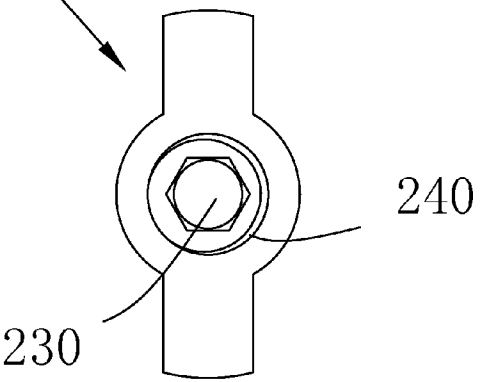
FIG. 42 is a back end elevational view of the second preferred embodiment of the impact mechanism of FIG. 40.
Figures 45, 46:
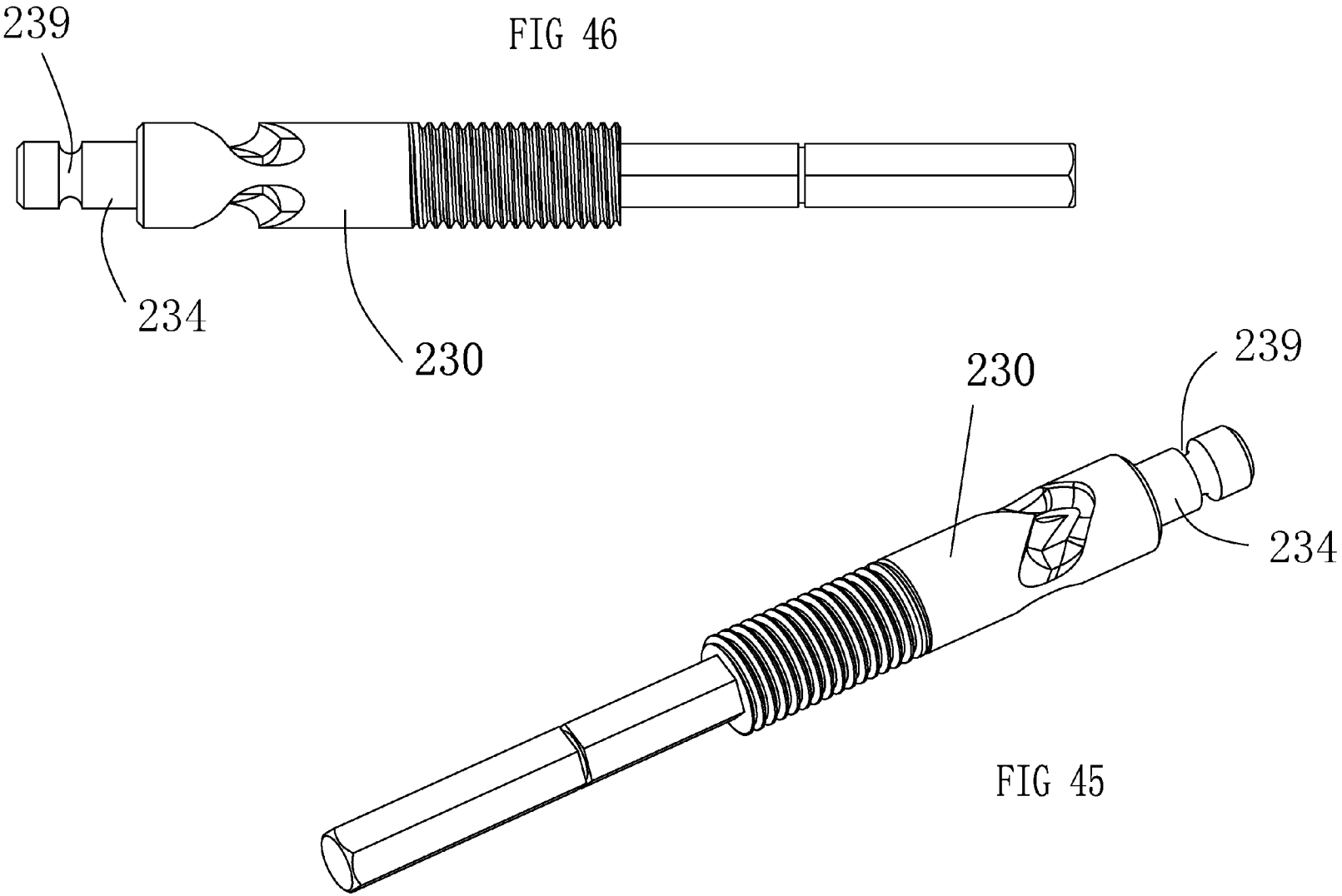
FIG. 45 is a perspective view of the drive engaging member of the second preferred embodiment of the impact mechanism of FIG. 40.
FIG. 46 is a side elevational view of the drive engaging member of FIG. 45.
Figure 49:
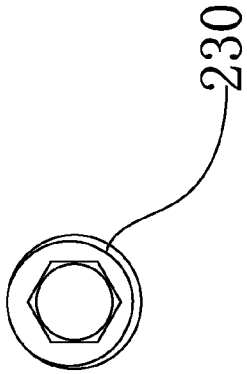
FIG. 49 is a back end elevational view of the drive engaging member of FIG. 45.
Figure 48:
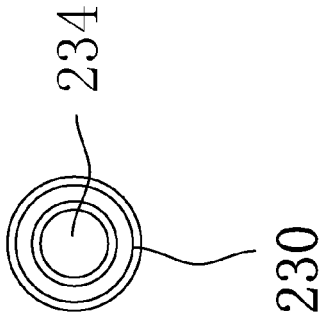
FIG. 48 is a front end elevational view of the drive engaging member of FIG. 45.
Figure 47:
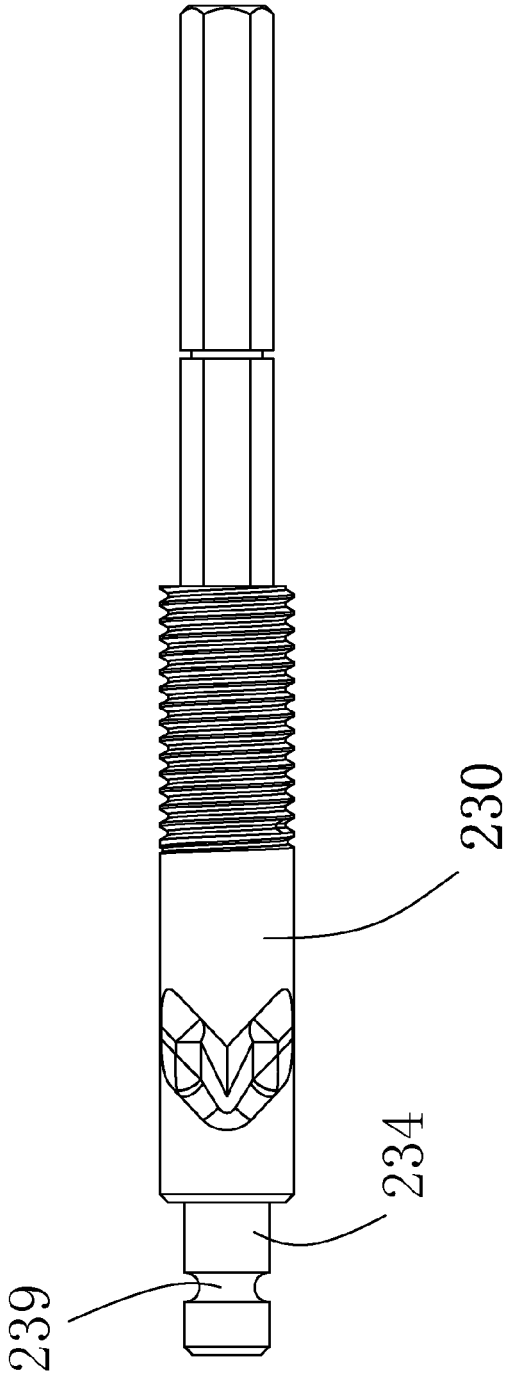
FIG. 47 is another side elevational view of the drive engaging member of FIG. 45.
Figure 51:
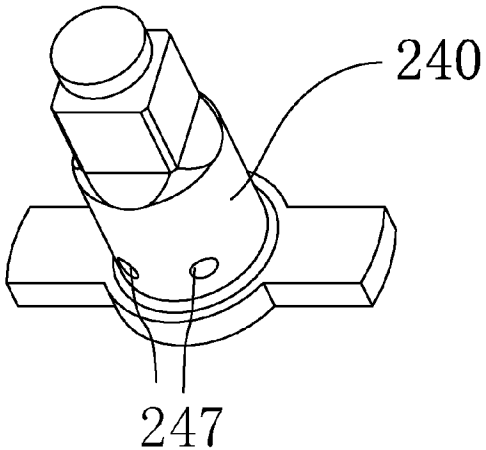
FIG. 51 is a perspective view of the tool bit retaining member of the second preferred embodiment of the impact mechanism of FIG. 40.
Figure 50:
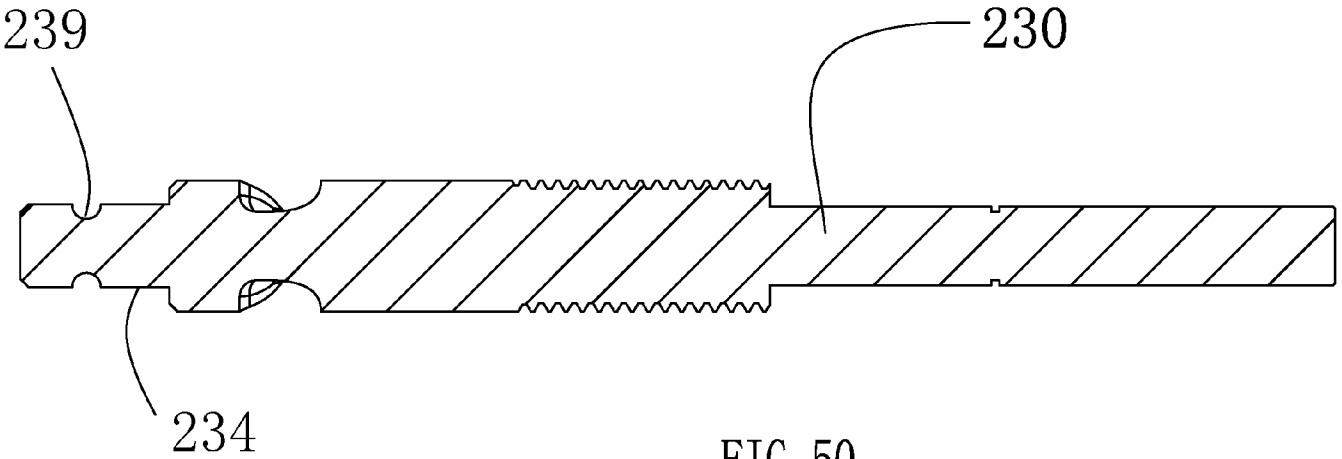
FIG. 50 is a cross-sectional side elevational view of the drive engaging member of FIG. 45, taken along section line 50-50 of FIG. 47.
Figure 53:
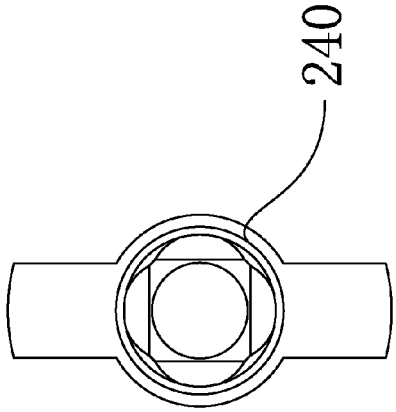
FIG. 53 is a front end elevational view of the tool bit retaining member of FIG. 51.
Figure 55:
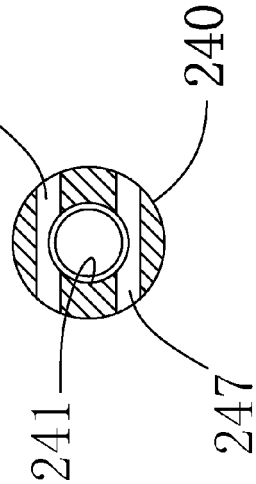
FIG. 55 is a cross-sectional end elevational view of the tool bit retaining member of FIG. 51, taken along section line 55-55 of FIG. 52.
Figure 52:
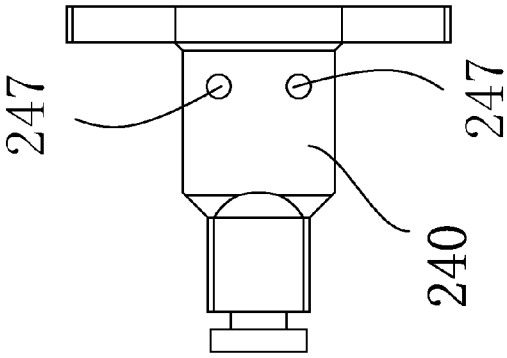
FIG. 52 is a side elevational view of the tool bit retaining member of FIG. 51.
Figure 54:
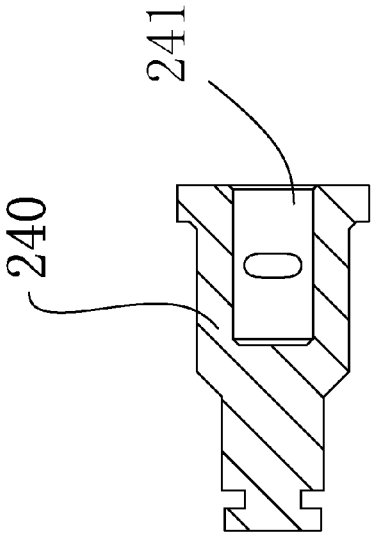
FIG. 54 is a cross-sectional side elevational view of the tool bit retaining member of FIG. 51, taken along section line 54-54 of FIG. 52.
Figure 57:
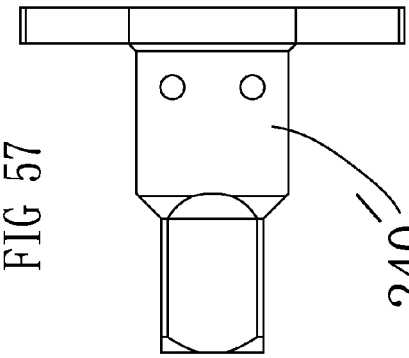
FIG. 57 is a side elevational view of the alternative embodiment tool bit retaining member of FIG. 56.
Figure 56:
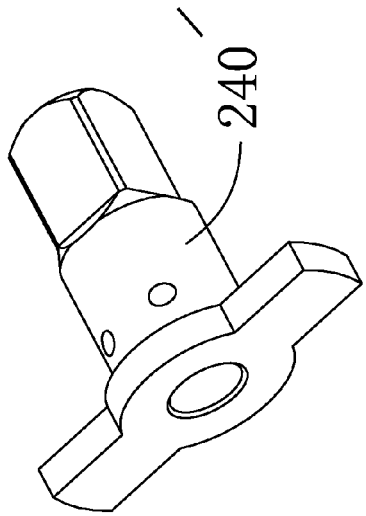
FIG. 56 is a perspective view of an alternative embodiment tool bit retaining member.
Figure 59:
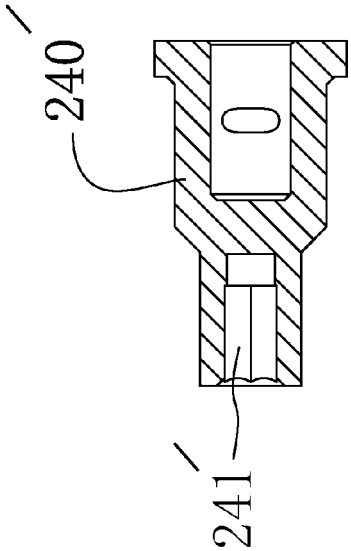
FIG. 59 is a cross-sectional side elevational view of the alternative embodiment tool bit retaining member of FIG. 56, taken along section line 59-59 of FIG. 56; and, FIG. 60 is a cross-sectional end elevational view of the alternative embodiment tool bit retaining member of FIG. 56, taken along section line 60-60 of FIG. 56.
Figure 58:
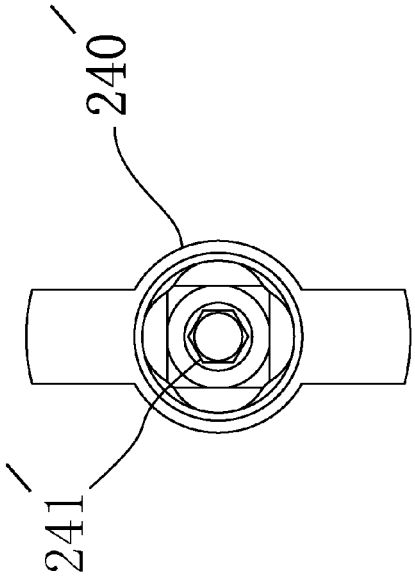
FIG. 58 is a front end elevational view of the alternative embodiment tool bit retaining member of FIG. 56.
Figure 60:
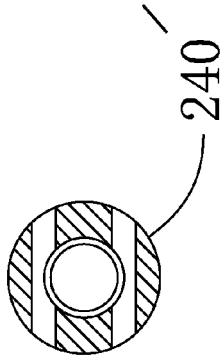

Referring to FIGS. 1 through 60 of the drawings, it will be noted that FIGS. 1 through 39 illustrate a first preferred embodiment of the impact mechanism of the present invention, FIGS. 40 through 55 illustrate a second preferred embodiment of the impact mechanism of the present invention, and FIGS. 56 through 60 illustrate a third preferred embodiment of the impact mechanism of the present invention.

Reference will now be made to FIGS. 1 through 39, which show a first preferred embodiment of the impact mechanism of the present invention, as indicated by general reference numeral 20. The impact mechanism 20 is for use with a drive motor. The impact mechanism 20 comprises a drive engaging member 30 for engaging a rotatable output, such as a chuck, as drive by a drive motor, such as an electric drill, for rotation therewith about a longitudinal axis "L" about which the drive engaging member 30 rotates.

In the first first preferred embodiment as illustrated, the drive engaging member 30 comprises a chuck-engageable portion for engagement into the chuck of the drill. The chuck-engageable portion 32 is preferably hexagonally shaped, or of any other suitable shape, for secure engagement into the chuck of a drill for rotation therewith.

There is also a tool bit retaining member 40 operatively inter-connected with the drive engaging member 30 for rotation with respect to the drive engaging member 30 about the longitudinal axis. As can be seen in the Figures, the drive engaging member 30 is disposed immediately rearwardly of the tool bit retaining member 40. The tool bit retaining member 40 has a main body portion 42, an anvil portion 44 securely attached thereto for co-rotation with the main body portion 42, and a tool bit retaining means 46 securely attached thereto for co-rotation with the main body portion 42.

The main body portion 42 of the tool bit retaining member 40 is longitudinally elongate and has an elongate throughpassage 41, and a forward cylindrical portion 34 that is preferably reduced in diameter. The forward cylindrical portion 34 of the drive engaging member 30 is also preferably reduced in diameter and is received and retained within the elongate throughpassage 41 of the main body portion 42 of the tool bit retaining member 40. The foremost portion 36 of the forward cylindrical portion 34 of the drive engaging member 30 projects externally forwardly from the main body portion 42 of the tool bit retaining member 40.

The impact mechanism 20 further comprises an enlarged stop member 38 disposed on the front end of the drive engaging member 30 to limit the relative longitudinal movement of the drive engaging member 30 and the tool bit retaining member 40 with respect to each other. Preferably, the enlarged stop member 38 is welded to the very front end of the drive engaging member 30, for purposes of strength and rigidity, after the impact mechanism 20 is assembled, or at least after the drive engaging member 30 has been inserted into the tool bit retaining member 40. The enlarged stop member 38 is shown separated from the drive engaging member 30 in FIGS. 6 through 11.

As can be best seen in FIGS. 12 through 17, the anvil portion 44 is integrally formed with the tool bit retaining member 40. Preferably, the anvil portion 44 comprises first and second squared anvils 44*a*,44*b* disposed at the back end of the tool bit retaining member 40. Each of the first and second squared anvils 44*a*,44*b* projects radially outwardly from the main body portion 42 of the tool bit retaining member 40.

A hammer member 50 is mounted on one of the drive engaging member 30 and the tool bit retaining member 40 for movement between an anvil contact position and a release position. In the anvil contact position, force is transmitted from the hammer member 50 to the anvil portion 44 so as to create a moment about the longitudinal axis. In the release position, the hammer member 50 is temporarily removed from the anvil portion 44.

The hammer member 50 preferably comprises an annular main body 52 and at least one hammer head portion 54 projecting forwardly from the annular main body 52. In the first preferred embodiment, as illustrated, the at least one hammer head portion 54 comprises first and second hammer head portions 54*a*,54*b* projecting forwardly from the annular main body 52. The annular main body 52 and the first and second hammer head portions 54*a*,54*b* are integrally formed one with the others for reasons of ease of manufacturing and structural strength and rigidity. Preferably, the hammer member 50 is more massive than the anvil portion 44 of the tool bit retaining member 40, in order to be able to impart sufficient energy to the anvil portion 44 when the hammer member 50 impacts the anvil portion 44.

There is also a guide means 60 for moving the hammer member 50 between the anvil contact position and the release position when the drive engaging member 30 is rotated with respect to the tool bit retaining member 40. The guide means 60 is disposed on the forward cylindrical portion 34 and comprises first and second "V"-shaped grooves 62*a*,62*b* in the outer surface 31 of the drive engaging member 30, a co-operating first and second races 51*a*,51*b* in an interior surface 53 of the hammer member 50. A first ball bearing 64*a* is operatively engaged in the first "V"-shaped groove 62*a* and the first race 51*a*. Similarly, a second ball bearing 64*b* is operatively engaged in the second "V"-shaped groove 62*b* and the second race 51*b*. As can be seen in FIGS. 4 through 7, the hammer member 50 surrounds the drive engaging member 30 and is retained in space relation from the drive engaging member 30 by the first and second ball bearings 64*a*,64*b*.

There is a spring means 70 operatively interconnected between the drive engaging member 30 and the hammer member 50 for biasing the hammer member 50 to the anvil contact position. The spring means 70 preferably comprises a coil spring, but may alternatively comprising the other suitable type of spring. The mounting of the coil spring 70 will be discussed in greater detail subsequently.

The impact mechanism 20 further comprises a housing 80 substantially surrounding the drive engaging member 30 forwardly of the chuck-engageable portion 32, the anvil portion 44 of the tool bit retaining member 40, the hammer member 50, and the spring means 70. The housing 80 comprises an annular main body portion 82 terminating forwardly in a front wall portion 84, and terminating rearwardly in a rear oping 85. There is also a back end wall 86 removably and replaceably mountable on the annular main body portion 82 of the housing 80. The back end wall 86 is retained in place by threaded fasteners 81(only one shown)that extend through apertures 81*a* in the back end of the annular main body portion 82 of the housing 80 and threadibly engage co-operating apertures 86*b* in the end cap 86.

The impact mechanism 20 further comprises a selectively adjustable spring compression mechanism, as indicated by the general reference numeral 90, for permitting selective compression of the coil spring 70. The selectively adjustable spring compression mechanism 90 comprises an annular main body member 92 having an internal right-hand thread 94 and a reduced forward portion 96 and an annular lip 97. The annular main body member 92 is threadibly engaged on a co-operating external right-hand thread 38 on the drive engaging member 30.

The coil spring 70 is operatively interconnected between the annular main body member 92 and the hammer member 50. More specifically, a rear portion of the coil spring 70 is disposed in surrounding relation around the reduced forward portion 96 of the annular main body member 92. The coil spring 70 connected as such permits selective compression of the coil spring 70 through rotation of the annular main body member 92, as will now be described.

The annular main body member 92 also has a manually grippable portion 98 that extends through a co-operating aperture in the back end wall 86 of the housing 80 such that the manually grippable portion 98 is disposed exteriorly to the housing 80. When the manually grippable portion 98 is rotated in a clockwise direction, the annular main body member 92 is advanced forwardly along the drive engaging member 30, thus further compressing the coil spring 70. Conversely, when the manually grippable portion 98 is rotated in a counter-clockwise direction, the annular main body member 92 is retracted rearwardly along the drive engaging member 30, thus permitting expansion of the coil spring 70.

Reference will now be made to FIGS. 40 through 60, which show a second preferred embodiment of the impact mechanism according to the present invention, as indicated by reference numeral 220. The second preferred embodiment impact mechanism 220 is similar to the first preferred embodiment impact mechanism 20, except that the drive engaging member 230 does not extend all of the way through the tool bit retaining member 240. Instead, the tool bit retaining member 240 has a orifice 241 at its back end, instead of an elongate throughpassage. The orifice 241 is circular in cross-section to permit the co-operatingly shaped forward cylindrical portion 234 of the drive engaging member 230. The tool bit retaining member 240 is kept in place on the drive engaging member 230 by means of two pins 245 extending through co-operating bore holes 247 in the 240 and engaging an annular cut 239 in the forward cylindrical portion 234.

FIGS. 56 through 60 show an alternative embodiment of the tool bit retaining member 240' that has a hexagonal orifice 241' at its front end for receiving tool bits therein.

As can be understood from the above description and from the accompanying drawings, the present invention provides a portable impact driver that is operatively engageable with the chuck of an electric drill or the like, which portable impact driver provides a high impact rotational force, and wherein it is possible to readily adjust the impact rotational force of the portable impact driver, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the impact mechanism of the present invention without departing from the spirit and scope of the accompanying claims.

I claim:

1. An impact mechanism having a chuck-engageble portion that attaches to the distal end of a chuck of a drive motor tool for enabling the drive motor tool to perform selective impact loads, said impact mechanism comprising:

a drive engaging member having a chuck-engageable portion for engaging a rotatable output of a drive motor for rotation therewith about a longitudinal axis;

a tool bit retaining member operatively inter-connected with said drive engaging member for rotation with respect to said drive engaging member about said longitudinal axis, said tool bit retaining member having a main body portion, an anvil portion securely attached thereto for co-rotation with said main body portion, and a tool bit retaining means for co-rotation with said main body portion;

a hammer member mounted on one of said drive engaging member and said tool bit retaining member for movement between an anvil contact position whereat force is transmitted from said hammer member to said anvil portion so as to create a moment about said longitudinal axis, and a release position whereat said hammer member is temporarily removed from said anvil portion;

means for moving said hammer member between said anvil contact position and said release position when said drive engaging member is rotated with respect to said tool bit retaining member;

a spring operatively interconnected between said drive engaging member and said hammer member for biasing said hammer member to said anvil contact position; and, a main body member having an internal thread, and threadably engaged on a co-operating external thread on said drive engaging member;

wherein said spring is operatively interconnected between said main body member and said hammer member, to thereby permit selective compression of said spring through rotation of said main body member;

wherein, in use, rotation of said drive engaging member about said longitudinal axis causes said hammer member to move from its anvil contact position towards its release position, thereby storing potential energy in said spring; and, wherein, when said hammer member reaches said release position, said hammer member is forcefully propelled by said spring and the rotation of said drive engaging member to impact on said anvil portion, thus urging said tool bit retaining member to forcefully rotate about said longitudinal axis.

2. The impact mechanism of claim 1, wherein said main body member comprises an annular main body member.

3. The impact mechanism of claim 2, wherein said spring comprises a coil spring.

4. The impact mechanism of claim 3, wherein said annular main body member has a reduced forward portion.

5. The impact mechanism of claim 3, wherein a rear portion of said coil spring is disposed in surrounding relation around said reduced forward portion of said annular main body member.

6. The impact mechanism of claim 2, further comprising a housing substantially surrounding said drive engaging member forwardly of a chuck-engageable portion, said anvil portion of said tool bit retaining member, said hammer member, and said spring.

7. The impact mechanism of claim 6, wherein said annular main body member has a manually grippable portion that is disposed exteriorly to said housing.

8. The impact mechanism of claim 7, wherein said housing comprises an annular main body portion terminating forwardly in a front wall portion and terminating rearwardly in a rear opening, and further comprising a back end wall removably and replaceably mountable on said annular main body portion of said housing.

9. The impact mechanism of claim 8, wherein said manually grippable portion extends through a co-operating aperture in said back end wall of said housing.

10. The impact mechanism of claim 2, wherein said main body portion of said tool bit retaining member is longitudinally elongate and has an elongate throughpassage, and a forward cylindrical portion of said drive engaging member is received and retained within said elongate throughpassage of said main body portion of said tool bit retaining member.

11. The impact mechanism of claim 10, wherein the foremost portion of said forward cylindrical portion of said drive engaging member projects externally forwardly from said main body portion of said tool bit retaining member.

12. The impact mechanism of claim 11, further comprising an enlarged stop member disposed on the front end of said drive engaging member to limit the relative longitudinal movement of said drive engaging member and said tool bit retaining member.

13. The impact mechanism of claim 10, wherein said forward cylindrical portion of said drive engaging member is reduced in diameter.

14. The impact mechanism of claim 1, wherein said drive engaging member is disposed immediately rearwardly of said tool bit retaining member.

15. The impact mechanism of claim 10, wherein said means is disposed on said drive engaging member between said external thread and said forward cylindrical portion of said drive engaging member that is received and retained within said elongate throughpassage of said main body portion of said tool bit retaining member.

16. The impact mechanism of claim 15, wherein said means for moving said hammer member comprises a "V"-shaped groove in the outer surface of said forward cylindrical portion, a race in an interior surface of said hammer member, and a ball bearing operatively engaging said "V"-shaped groove and said race.

17. The impact mechanism of claim 1, wherein said hammer member has an annular main body and at least one hammer head portion projecting forwardly from said annular main body.

18. The impact mechanism of claim 17, wherein said at least one hammer head portion comprises first and second hammer head portions projecting forwardly from said annular main body.

19. The impact mechanism of claim 18, wherein said annular main body and said first and second hammer head portions are integrally formed one with the other.

20. The impact mechanism of claim 1, wherein said hammer member is more massive than said anvil portion of said tool bit retaining member.

21. The impact mechanism of claim 1, wherein said spring is in compression when said impact mechanism is at rest.

22. The impact mechanism of claim 1, wherein said anvil portion is integrally formed with said tool bit retaining member.

23. The impact mechanism of claim 22, wherein said anvil portion comprises first and second squared anvils each projecting radially outwardly from said main body portion of said tool bit retaining member.

24. The impact mechanism of claim 23, wherein said first and second squared anvils are disposed at the back end of said tool bit retaining member.

* * * * *